US009275650B2

(12) United States Patent
Ishikawa et al.

(10) Patent No.: US 9,275,650 B2
(45) Date of Patent: Mar. 1, 2016

(54) HYBRID AUDIO ENCODER AND HYBRID AUDIO DECODER WHICH PERFORM CODING OR DECODING WHILE SWITCHING BETWEEN DIFFERENT CODECS

(75) Inventors: Tomokazu Ishikawa, Osaka (JP); Takeshi Norimatsu, Hyogo (JP); Haishan Zhong, Singapore (SG); Kok Seng Chong, Singapore (SG); Huan Zhou, Singapore (SG)

(73) Assignee: PANASONIC CORPORATION, Osaka (JP)

( * ) Notice: Subject to any disclaimer, the term of this patent is extended or adjusted under 35 U.S.C. 154(b) by 369 days.

(21) Appl. No.: 13/703,044

(22) PCT Filed: Jun. 14, 2011

(86) PCT No.: PCT/JP2011/003352

§ 371 (c)(1),
(2), (4) Date: Dec. 10, 2012

(87) PCT Pub. No.: WO2011/158485

PCT Pub. Date: Dec. 22, 2011

(65) Prior Publication Data

US 2013/0090929 A1 Apr. 11, 2013

(30) Foreign Application Priority Data

Jun. 14, 2010 (JP) ..... 2010-134848

(51) Int. Cl.
*G10L 19/02* (2013.01)
*G10L 19/04* (2013.01)
(Continued)

(52) U.S. Cl.
CPC ..... *G10L 19/04* (2013.01); *G10L 19/0212* (2013.01); *G10L 19/107* (2013.01); *G10L 19/20* (2013.01); *G10L 19/022* (2013.01)

(58) Field of Classification Search
CPC . G10L 19/02; G10L 19/0208; G10L 19/0212; G10L 19/18; G10L 19/20
See application file for complete search history.

(56) References Cited

U.S. PATENT DOCUMENTS 7,596,486 B2 9/2009 Ojala et al.
8,095,359 B2 1/2012 Boehm et al.
(Continued)

FOREIGN PATENT DOCUMENTS

CN 1774957 A 5/2006
CN 101051465 A 10/2007
(Continued)

OTHER PUBLICATIONS

Milan Jelínek et al., "Wideband Speech Coding Advances in VMR-WB Standard", IEEE Transactions on Audio, Speech, and Language Processing, vol. 15, No. 4, May 2007.
(Continued)

*Primary Examiner* — Michael N Opsasnick
(74) *Attorney, Agent, or Firm* — Wenderoth, Lind & Ponack, L.L.P.

(57) ABSTRACT

A new hybrid audio decoder and a new hybrid audio encoder having block switching for speech signals and audio signals are provided. Currently, very low bitrate audio coding methods for speech and audio signals are proposed. These audio coding methods cause very long delays. Generally, in coding an audio signal, an algorithm delay tends to be long to achieve higher frequency resolution. In coding a speech signal, the delay needs to be reduced because the speech signal is used for telecommunication. To balance fine coding quality for speech and audio input signals with very low bitrate, a combination of a low delay filter bank like AAC-ELD and a CELP coding method is provided.

14 Claims, 24 Drawing Sheets

(51) Int. Cl.

| | |
|---|---|
| ***G10L 19/107*** | (2013.01) |
| ***G10L 19/20*** | (2013.01) |
| *G10L 19/022* | (2013.01) |

(56) References Cited

U.S. PATENT DOCUMENTS

| | | | | |
|---|---|---|---|---|
| 8,098,727 | B2 | 1/2012 | Gartner et al. | |
| 8,311,809 | B2 | 11/2012 | Schuijers et al. | |
| 8,392,179 | B2 * | 3/2013 | Yu et al. | 704/214 |
| 8,447,620 | B2 | 5/2013 | Neuendorf et al. | |
| 8,595,019 | B2 | 11/2013 | Geiger et al. | |
| 8,751,246 | B2 | 6/2014 | Lecomte et al. | |
| 8,892,449 | B2 | 11/2014 | Lecomte et al. | |
| 8,930,198 | B2 | 1/2015 | Grill et al. | |
| 2004/0156397 | A1 | 8/2004 | Heikkinen et al. | |
| 2005/0261900 | A1 | 11/2005 | Ojala et al. | |
| 2007/0038439 | A1 | 2/2007 | Schuijers et al. | |
| 2007/0112559 | A1 | 5/2007 | Schuijers et al. | |
| 2007/0286276 | A1 | 12/2007 | Gartner et al. | |
| 2009/0012797 | A1 | 1/2009 | Boehm et al. | |
| 2009/0040997 | A1 * | 2/2009 | Oh et al. | 370/345 |
| 2009/0044230 | A1 * | 2/2009 | Oh et al. | 725/62 |
| 2009/0299757 | A1 * | 12/2009 | Guo et al. | 704/500 |
| 2010/0023323 | A1 * | 1/2010 | Gournay et al. | 704/219 |
| 2010/0023324 | A1 * | 1/2010 | Gournay et al. | 704/219 |
| 2011/0096930 | A1 | 4/2011 | Walmsley | |
| 2011/0173008 | A1 | 7/2011 | Lecomte et al. | |
| 2011/0173010 | A1 | 7/2011 | Lecomte et al. | |
| 2011/0173011 | A1 | 7/2011 | Geiger et al. | |
| 2011/0202354 | A1 | 8/2011 | Grill et al. | |
| 2011/0238425 | A1 | 9/2011 | Neuendorf et al. | |
| 2013/0096930 | A1 | 4/2013 | Neuendorf et al. | |

FOREIGN PATENT DOCUMENTS

| | | | |
|---|---|---|---|
| CN | 101325060 | A | 12/2008 |
| CN | 101661749 | A | 3/2010 |
| JP | 2007-538283 | | 12/2007 |
| WO | 2004/093494 | A1 | 10/2004 |
| WO | 2005/114654 | | 12/2005 |
| WO | 2010/003532 | | 1/2010 |
| WO | 2010/040522 | | 4/2010 |
| WO | 2011/013980 | A2 | 2/2011 |

OTHER PUBLICATIONS

Chinese Office Action and Search Report issued Jan. 19, 2015 in corresponding Chinese Application No. 201180028085.9 (with partial English translation).

Extended European Search Report issued Mar. 6, 2015 in corresponding European Application No. 11795393.5.

Jeremie Lecomte et al., "Efficient Cross-fade windows for transitions between LPC-based and non-LPC based audio coding," AES Convention 126, May 7-10, 2009, AES, 60 East 42nd Street, Room 2520, NY 10165-2520, May 1, 2009, XP040508994, pp. 1-9.

Min Lu et al., "Dual-mode Switching Used for Unified Speech and Audio Codec," Audio Language and Image Processing (ICALIP, 2010 International Conference ON, IEEE, Piscataway, NJ, Nov. 23, 2010, pp. 700-704, XP031847468, ISBN: 978-1-4244-5856-1.

Jeremie Lecomte et al., "Efficient Cross-fade windows for transitions between LPC-based and non-LPC based audio coding," AES Convention 126, May 7-10, 2009, AES, 60 East 42nd Street, Room 2520, NY 10165-2520, May 1, 2009, XP040508994, p. 5, right-hand column, p. 6, left-hand column.

Guillaume Fuchs, et al., MDCT-Based Coder for Highly Adaptive Speech and Audio Coding, Proc. 17th European Signal Processing Conference, Scotland, EURASIP, Aug. 24, 2009, pp. 1264-1268.

Ravi K. Chivukula, et al., Efficient Algorithms for MPEG-4 AAC-ELD, AAC-LD and AAC-LC Filterbanks, Proc. International Conference on Audio, Language and Image Processing, 2008, China, IEEE, Jul. 7, 2008, pp. 1629-1634.

* cited by examiner

HYBRID AUDIO ENCODER AND HYBRID AUDIO DECODER WHICH PERFORM CODING OR DECODING WHILE SWITCHING BETWEEN DIFFERENT CODECS

TECHNICAL FIELD

The present invention relates to a hybrid audio encoder and a hybrid audio decoder which perform coding or decoding while switching between different codecs.

BACKGROUND ART

Speech codec is designed specially according to the characteristics of a speech signal [NPL 1]. The speech codec has the advantage of efficiently coding a speech signal. For example, the sound quality is high when a speech signal is coded in low bitrate, and the delay is low. However, the sound quality in coding an audio signal that is wideband compared to the speech signal is not as good as in the case of using some transform codecs such as the AAC scheme. On the other hand, the transform codec represented by the AAC scheme is suitable for coding an audio signal, but it requires higher bitrate to code a speech signal in order to achieve the same sound quality as the speech codec. The hybrid codec can code a speech signal and an audio signal with high sound quality at low bitrate. The hybrid codec combines the merits of the two different codecs in order to achieve coding with high sound quality at low bitrate.

A low delay hybrid codec is desired for real-time communication applications such as a teleconference system. One low delay hybrid codec combines the AAC-LD (low-delay AAC) coding technology with the speech coding technology. The AAC-LD provides a mode with an algorithm delay not exceeding 20 ms. The AAC-LD is derived from the normal AAC coding technology. In order to reduce the algorithm delay, the AAC-LD has some modifications on AAC. Firstly, the frame size of the AAC-LD is reduced to 1024 or 960 time domain samples, and thus the output spectral values of the MDCT filter bank are reduced to 512 and 480 spectral values, respectively. Secondly, in order to reduce the algorithm delay, look-ahead is disabled, and as a result, block switching is not used. Thirdly, a low-overlap window is used to replace the Kaiser-Bessel window used in the window function processing in the normal delay AAC. The low-overlap window is used for efficiently coding transient signals in the AAC-LD. Fourthly, the bit reservoir is minimized or not used at all. Fifthly, the temporal noise shaping and long-term prediction functions are adapted according to the low delay frame size.

Generally, the speech codec is based on linear prediction coding (algebraic code-excited linear prediction (ACELP)) [NPL 1]. For the ACELP coding, a linear prediction analysis is applied on a speech signal, and an algebraic codebook is used to code an excitation signal calculated by the linear prediction analysis. To further improve the sound quality of the ACELP coding, recent speech codec additionally uses the transform coded excitation coding (TCX coding). For the TCX coding, after linear prediction analysis, transform coding is applied on the excitation signal. The Fourier transformed weighted signal is quantized using algebraic vector quantization. Different frame sizes are available for speech codec, for example, 1024 time domain samples, 512 time domain samples, and 256 time domain samples. The coding mode is selected using the closed-loop analysis-by-synthesis method.

A low delay hybrid codec has three different coding modes, namely, the AAC-LD coding mode, the ACELP mode and the TCX mode. Since each mode codes a signal in a different domain and has a different frame size, the hybrid codec needs to have block switching methods for transition frames in which the coding mode switches. An example of the transition frame is illustrated in FIG. 2. For example, a pervious frame is coded in the AAC-ELD mode and a current frame is to be coded in the ACELP mode, the current frame is defined as a transition frame. In the prior art, to switch between different coding modes, the aliasing portion of the previous windowed frame is processed differently compared to the current portion of the current block in the transition frame (PTL 1: International Patent Application Publication WO2010/003532 by Fraunhofer Gesellschaft).

To facilitate the explanation of the present invention in the following sections, the transform and the inverse transform of the AAC-ELD is provided in this background section.

The transform processes of the AAC-ELD mode in the encoder are described as follows:

The number of processed AAC-ELD frames is 4. A frame i-1 is concatenated with three previous frames to form an extended frame with a length of 4N. Here, N is the size of the input frame. That is to say, to code a current picture to be coded, the AAC-ELD mode requires not only a sample of the current frame but also samples of the three frames previous to the current frame.

Firstly, window is applied on the extended frame in the AAC-ELD mode. FIG. 3 illustrates the encoder window shape in the AAC-ELD mode of the encoder. The window in the encoder is defined as $w_{enc}$. For the convenience of illustration, the encoder window is divided into eight parts, denoted as $[w_1, w_2, w_3, w_4, w_5, w_6, w_7, w_8]$. The length of the encoder window is 4N. The encoder window in the AAC-ELD mode is designed to match the low delay filter banks used in the AAC-ELD mode. For the convenience of explanation, one frame is divided into two parts as shown in FIG. 3. For example, the frame i-1 is divided into two vectors $[a_{i-1}, b_{i-1}]$. Here, $a_{i-1}$ has N/2 samples, and $b_{i-1}$ has N/2 samples. Therefore, the encoder window is applied on the vectors denoted as $[a_{i-4}, b_{i-4}, a_{i-3}, b_{i-3}, a_{i-2}, b_{i-2}, a_{i-1}, b_{i-1}]$, to obtain the windowed signal $[a_{i-4}w_1, b_{i-4}w_2, a_{i-3}w_3, b_{i-3}w_4, a_{i-2}w_5, b_{i-2}w_6, a_{i-1}w_7, b_{i-1}w_8]$.

Next, the low delay filter banks are used to transform the windowed signals. The low delay filter banks are defined as following:

$$x_k = -2\sum_{n=-2N}^{2N-1} x_n \cos\left[\frac{\pi}{N}\left(n+\frac{1}{2}-\frac{N}{2}\right)\left(k+\frac{1}{2}\right)\right] \quad \text{[Math. 1]}$$

where $x_n=[a_{i-4}w_1, b_{i-4}w_2, a_{i-3}w_3, b_{i-3}w_4, a_{i-2}w_5, b_{i-2}w_6, a_{i-1}w_7, b_{i-1}w_8]$.

According to the above low delay filter banks, the length of the output coefficients is N while the processing frame length is 4N.

The low delay filter bank can be expressed in terms of DCT-IV. The DCT-IV definition is shown as follows:

$$x_k = DCT-IV(x_n) = \sum_{n=0}^{N-1} x_n \cos\left[\frac{\pi}{N}\left(n+\frac{1}{2}\right)\left(k+\frac{1}{2}\right)\right] \quad \text{[Math. 2]}$$

According to the following identities:

$$\cos\left[\frac{\pi}{N}\left(-n-1+\frac{1}{2}\right)\left(k+\frac{1}{2}\right)\right]=\cos\left[\frac{\pi}{N}\left(n+\frac{1}{2}\right)\left(k+\frac{1}{2}\right)\right] \quad \text{[Math. 3]}$$

$$\cos\left[\frac{\pi}{N}\left(2N-n-1+\frac{1}{2}\right)\left(k+\frac{1}{2}\right)\right]=-\cos\left[\frac{\pi}{N}\left(n+\frac{1}{2}\right)\left(k+\frac{1}{2}\right)\right] \quad \text{[Math. 4]}$$

the signal of the frame i-1 transformed by the low delay filter banks can be expressed in term of DCT-IV as follows:

$$[DCT\text{-}IV(-(a_{i-4}w_1)_R-b_{i-4}w_2+(a_{i-2}w_5)_R+b_{i-2}w_6),$$

$$DCT\text{-}IV(-a_{i-3}w_3+(b_{i-3}w_4)_R+a_{i-1}w_7-(b_{i-1}w_8)_R)],$$

where $(a_{i-4}w_1)_R$, $(a_{i-2}w_5)_R$, $(b_{i-3}w_4)_R$, $(b_{i-1}w_8)_R$ denote the reverse order of vectors $a_{i-4}w_1$, $a_{i-2}w_5$, $b_{i-3}w_4$, $b_{i-1}w_8$ respectively.

The inverse transform processes in the AAC-ELD mode of the decoder are described below.

The following describes the case where the decoder decodes the frame i-1 in the AAC-ELD mode. FIG. 7 illustrates the inverse transform processes in the AAC-ELD mode. The inverse low delay filter banks of the AAC-ELD mode in the decoder are shown below.

$$y_n=-\frac{1}{N}\sum_{k=0}^{N-1}x_k\cos\left[\frac{\pi}{N}\left(n+\frac{1}{2}-\frac{N}{2}\right)\left(k+\frac{1}{2}\right)\right], \quad \text{[Math. 5]}$$

$$0\le n<4N$$

The length of the inverse transform signals of the low delay filter banks is 4N. As explained in Embodiment 1, the inverse transform signals for the frame i-1 are as follows:

$$y_{i-1}=$$

$$[-a_{i-4}w_1-(b_{i-4}w_2)_R+a_{i-2}w_5+(b_{i-2}w_6)_R,$$

$$-(a_{i-4}w_1)_R-b_{i-4}w_2+(a_{i-2}w_5)_R+b_{i-2}w_6,$$

$$-a_{i-3}w_3+(b_{i-3}w_4)_R+a_{i-1}w_7-(b_{i-1}w_8)_R,$$

$$(a_{i-3}w_3)_R-b_{i-3}w_4-(a_{i-1}w_7)_R+b_{i-1}w_8,$$

$$a_{i-4}w_1+(b_{i-4}w_2)_R-a_{i-2}w_5-(b_{i-2}w_6)_R,$$

$$(a_{i-4}w_1)_R+b_{i-4}w_2-(a_{i-2}w_5)_R-b_{i-2}w_6,$$

$$a_{i-3}w_3-(b_{i-3}w_4)_R-a_{i-1}w_7+(b_{i-1}w_8)_R,$$

$$-(a_{i-3}w_3)_R+b_{i-3}w_4+(a_{i-1}w_7)_R-b_{i-1}w_8] \quad \text{[Math. 6]}$$

After applying inverse low delay filter banks, window is applied on $y_{i-1}$ to obtain $$\bar{y}_{i-1}. \quad \text{[Math. 7]}$$

FIG. 6 illustrates the decoder window shape in the AAC-ELD mode. The length of the window in the AAC-ELD mode is 4N. It is the reverse order of the encoder window in the AAC-ELD mode. The window in the decoder is denoted as $w_{dec}$. For the convenience of illustration, the decoder window is divided into eight parts [$w_{R,8}$, $w_{R,7}$, $w_{R,6}$, $w_{R,5}$, $w_{R,4}$, $w_{R,3}$, $w_{R,2}$, $w_{R,1}$] as shown in FIG. 6.

The windowed inverse transform signals $$\bar{y}_{i-1} \quad \text{[Math. 8]}$$

are as follows:

$$\bar{y}_{i-1}=$$

$$[(-a_{i-4}w_1-(b_{i-4}w_2)_R+a_{i-2}w_5+(b_{i-2}w_6)_R)w_{R,8},$$

$$(-(a_{i-4}w_1)_R-b_{i-4}w_2+(a_{i-2}w_5)_R+b_{i-2}w_6)w_{R,7},$$

$$(-a_{i-3}w_3+(b_{i-3}w_4)_R+a_{i-1}w_7-(b_{i-1}w_8)_R)w_{R,6},$$

$$((a_{i-3}w_3)_R-b_{i-3}w_4-(a_{i-1}w_7)_R+b_{i-1}w_8)w_{R,5},$$

$$(a_{i-4}w_1+(b_{i-4}w_2)_R-a_{i-2}w_5-(b_{i-2}w_6)_R)w_{R,4},$$

$$((a_{i-4}w_1)_R-b_{i-4}w_2-(a_{i-2}w_5)_R-b_{i-2}w_6)w_{R,3},$$

$$(a_{i-3}w_3-(b_{i-3}w_4)_R-a_{i-1}w_7+(b_{i-1}w_8)_R)w_{R,2},$$

$$(-(a_{i-3}w_3)_R+b_{i-3}w_4+(a_{i-1}w_7)_R-b_{i-1}w_8)w_{R,1}] \quad \text{[Math. 9]}$$

For the next frame i coded in the AAC-ELD mode, the windowed inverse transform signals $$\bar{y}_i \quad \text{[Math. 10]}$$

are as follows:

$$\bar{y}_i=$$

$$[(-a_{i-3}w_1-(b_{i-3}w_2)_R+a_{i-1}w_5+(b_{i-1}w_6)_R)w_{R,8},$$

$$(-(a_{i-3}w_1)_R-b_{i-3}w_2+(a_{i-1}w_5)_R+b_{i-1}w_6)w_{R,7},$$

$$(-a_{i-2}w_3+(b_{i-2}w_4)_R+a_iw_7-(b_iw_8)_R)w_{R,6},$$

$$((a_{i-2}w_3)_R-b_{i-2}w_4-(a_iw_7)_R+b_iw_8)w_{R,5},$$

$$a_{i-3}w_1+(b_{i-3}w_2)_R-a_{i-1}w_5-(b_{i-1}w_6)_R)w_{R,4},$$

$$((a_{i-3}w_1)_R+b_{i-3}w_2-(a_{i-1}w_5)_R-b_{i-1}w_6)w_{R,3},$$

$$(a_{i-2}w_3-(b_{i-2}w_4)_R-a_iw_7+(b_iw_8)_R)w_{R,2},$$

$$(-(a_{i-2}w_3)_R+b_{i-2}w_4+(a_iw_7)_R-b_iw_8)w_{R,1}] \quad \text{[Math. 11]}$$

In order to reconstruct the signal [$a_{i-1}$, $b_{i-1}$] of the frame i, the overlapping and adding process requires three previous frames. FIG. 7 illustrates the overlapping and adding process in the AAC-ELD mode. The length of the reconstructed signals $out_i$ is N.

The overlapping and adding processes can be expressed as the following equation:

$$out_{i,n}=\bar{y}_{i,n}+\bar{y}_{i-1,n+N}+\bar{y}_{i-2,n+2N}+\bar{y}_{i-3,n+3N}, 0\le n<N \quad \text{[Math. 12]}$$

The aliasing cancellation mechanism of the AAC-ELD is illustrated in FIG. 22. The windowed inverse transform signal of the frame i, the frame i-1, the frame i-2, and the frame i-3 are shown in FIG. 22. For the purpose of visualization, the graphs show an example of a special case where $$a_i=1, b_i=1\,\forall i. \quad \text{[Math. 13]}$$

$$(-a_{i-3}w_1-(b_{i-3}w_2)_R+a_{i-1}w_5+(b_{i-1}w_6)_R)w_{R,8}+$$

$$(-a_{i-3}w_3+(b_{i-3}w_4)_R+a_{i-1}w_7-(b_{i-1}w_8)_R)w_{R,6}+$$

$$(a_{i-5}w_1+(b_{i-5}w_2)_R-a_{i-3}w_5-(b_{i-3}w_6)_R)w_{R,4}+$$

$$(a_{i-5}w_3-(b_{i-5}w_4)_R-a_{i-3}w_7+(b_{i-3}w_8)_R)w_{R,2}=$$

$$a_{i-5}(w_3w_{R,2}+w_1w_{R,4})+a_{i-3}(-w_7w_{R,2}-w_5w_{R,4}-w_3w_{R,6}-w_1w_{R,8})+a_{i-1}(w_7w_{R,6}+w_5w_{R,8}) \quad \text{[Math. 14]}$$

The window is designed to possess the following properties:

$$(w_3w_{R,2}+w_1w_{R,4})_R\approx 0$$

$$(-w_7w_{R,2}-w_5w_{R,4}-w_3w_{R,6}-w_1w_{R,8})_R\approx 0$$

$$(w_7w_{R,6}+w_5w_{R,8})_R\approx 1 \quad \text{[Math. 15]}$$

A signal $a_{i-1}$ is reconstructed after the overlapping and adding.

The same analysis method is used to reconstruct a signal $b_{i-1}$.

$$(-(a_{i-3}w_1)_R-b_{i-3}w_2+(a_{i-1}w_5)_R+b_{i-1}w_6)w_{R,7}+$$

$$((a_{i-3}w_3)_R-b_{i-3}w_4-(a_{i-1}w_7)_R+b_{i-1}w_8)w_{R,5}+$$

$$((a_{i-5}w_1)_R+b_{i-5}w_2-(a_{i-3}w_5)_R-b_{i-3}w_6)w_{R,3}+$$

$$(-(a_{i-5}w_3)_R+b_{i-5}w_4+(a_{i-3}w_7)_R-b_{i-3}w_8)w_{R,1}=$$

$$b_{i-5}(w_2w_{R,3}+w_4w_{R,1})+b_{i-3}(-w_2w_{R,7}-w_4w_{R,5}-w_6w_{R,3}-w_8w_{R,1})+b_{i-1}(w_6w_{R,7}+w_8w_{R,5}) \quad \text{[Math. 16]}$$

$$(w_3w_{R,2}+w_1w_{R,4})_R\approx 0$$

$$(-w_7w_{R,2}-w_5w_{R,4}-w_3w_{R,6}-w_1w_{R,8})_R\approx 0$$

$$(w_7w_{R,6}+w_5w_{R,8})_R\approx 1 \quad \text{[Math. 17]}$$

A signal $b_{i-1}$ is reconstructed after the overlapping and adding.

CITATION LIST

Patent Literature

[PTL 1] Fuchs, Guillaume "Apparatus and method for encoding/decoding and audio signal using an aliasing switch scheme", International Patent Application Publication WO2010/003532

Non Patent Literature

[NPL 1] Milan Jelinek, "Wideband Speech Coding Advances in VMR-WB Standard", IEEE Transactions on Audio, Speech and Language Processing, Vol. 15, No. 4, May 2007

Technical Problem

The sound quality of the low delay hybrid codec which uses the AAC-LD is relatively narrowband and is thus not satisfactory although it has low delay compared to when the normal delay AAC is used.

To improve the sound quality (in particular, to increase the bandwidth of the sound) of the hybrid codec, the AAC-LD mode can be replaced by the AAC-ELD coding mode. The AAC-ELD further reduces the delay of the hybrid codec which employs the AAC-LD.

However, there are problems with building a hybrid codec using the AAC-ELD. With the AAC-ELD, a frequency conversion is performed using a sample overlapping with a previous frame, whereas with the ACELP mode and the TCX mode, the coding can be completed with a sample of the current frame only. Thus, when switching between different coding modes, e.g., between the AAC-ELD mode and the ACELP or TCX mode, aliasing is introduced in the transition frames where the mode is switched. The aliasing results in unnatural sound. With the block switching algorithms in the prior art, the aliasing cannot be cancelled because the coding structure of the low delay hybrid codec which employs the AAC-ELD is different from other hybrid codecs in the prior art. In the prior art, the block switching algorithms are designed to switch between the AAC-LD mode and the ACELP or TCX mode. Without any modification, these algorithms are not applicable to the block switching between the AAC-ELD mode and the ACELP or TCX mode.

That is to say, in order to seamlessly combine the AAC-ELD coding technology with the ACELP and TCX coding technologies in a low delay hybrid codec to reduce deterioration in the sound quality attributable to the aliasing, new block switching algorithms are needed to handle the transition frame where the coding mode is switched.

The other problem of the low delay hybrid codec is the low sound quality, because it lacks a good scheme for coding the transient signal. The AAC-ELD uses only one type of window shape which adapts to the low delay filter bank. The window shape in the AAC-ELD is long. The long window shape of the AAC-ELD causes a poor coding quality for the transient signal. A better transient signal coding method for the AAC-ELD is necessary to improve the sound quality of the low delay hybrid codec.

SUMMARY OF INVENTION

Solution to Problem

An object of the present invention is to solve the deterioration in the sound quality caused when different coding modes are switched in the low delay hybrid codec.

The present invention provides optimal block switching algorithms in an encoder and a decoder for a hybrid speech and audio codec in order to switch coding modes seamlessly to reduce the deterioration in the sound quality caused at the time of switching. The switching schemes according to an aspect of the present invention are different from the prior art which processed the aliasing portion of the windowed block differently compared to the subsequent portion of the transition block. That is to say, the non-aliasing portions of the previous frames are processed and used to cancel the aliasing in the current switching frame. No different coding technology is used for different portions of the frames.

The block switching algorithms are used to handle the transition frames where:

the AAC-ELD mode is switched to the ACELP mode;
the ACELP mode is switched to the AAC-ELD mode;
the AAC-ELD mode is switched to the TCX mode; or
the TCX mode is switched to the AAC-ELD mode.

Furthermore, the bitrate of block switching from the ACELP mode to the AAC-ELD mode for the low delay hybrid codec may be reduced. Instead of using the low delay filter banks, the normal MDCT filter bank similar to the low delay filter banks is used for the purpose of reducing the bitrate required for the switching from the ACELP mode to the AAC-ELD mode.

Moreover, the sound quality may be improved by designing a block switching scheme for handing the transient signal in the low delay hybrid codec. Short windowing may be used for encoding the transient signal because of the abrupt energy change in the transient signal. This allows seamless connection from the short window to the long window in the AAC-ELD mode.

DESCRIPTION OF EMBODIMENTS

The following embodiments illustrate the principles of various inventive steps. Variations of the specific examples described herein will be apparent to those skilled in the art.

Embodiment 1

In Embodiment 1, a hybrid speech and audio encoder having block switching algorithms is invented to code a transition frame that is a frame where the AAC-ELD mode is being switched to the ACELP mode.

In order to cancel previous frame's aliasing introduced by the AAC-ELD mode in the decoder, the frame size of the ACELP is extended. The aliasing which occurs when the AAC-ELD mode is switched to the ACELP mode is attributable to the fact that while the AAC-ELD mode requires a sample of the previous frame to code a current frame to be coded, the ACELP only uses a sample of the current frame, i.e., one frame, to code the current frame. In contrast, the second half of the previous frame preceding the current frame is concatenated with the current frame to form an extended frame, which is longer than a normal input frame size. The extended frame is coded in the ACELP mode by the encoder.

Figure 20:
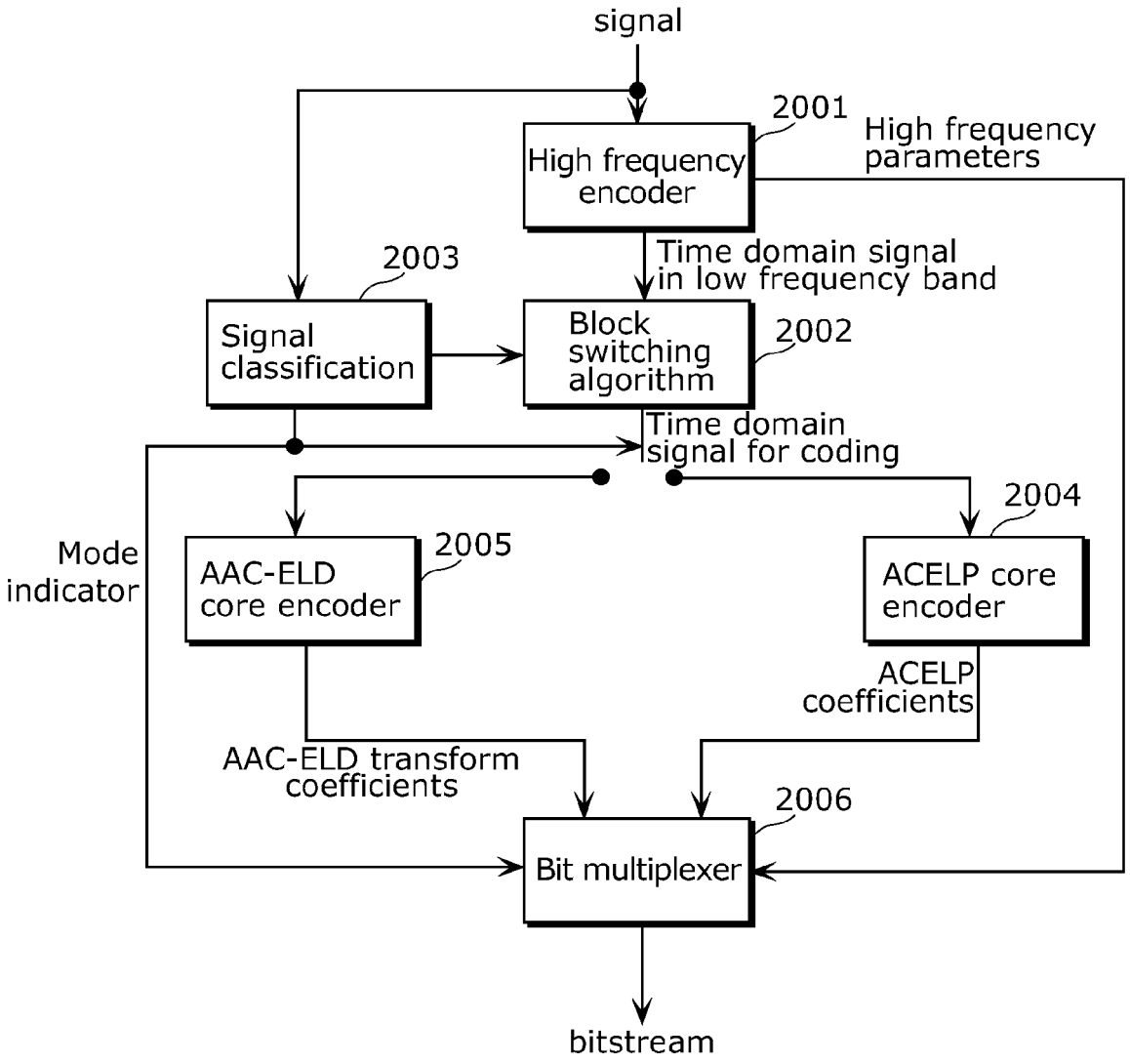
FIG. 20 is a block diagram illustrating a framework of a low delay hybrid encoder having two encoding modes.

FIG. 20 is a block diagram illustrating a framework of a hybrid encoder which combines the AAC-ELD coding technology with the ACELP coding technology. In FIG. 20, an incoming signal is sent to a high frequency encoder 2001. The coded high frequency parameters are sent to a bit multiplexer block 2006. The incoming signal is also sent to a signal classification block 2003. The signal classification decides which coding mode is selected for a time domain signal in low frequency band. A mode indicator from the signal classification block 2003 is sent to the bit multiplexer block 2006. The mode indicator is also used for controlling a block switching algorithm 2002. The current time domain signal in low frequency band to be coded is sent to a corresponding encoder 2004, 2005 according to the mode indicator. The bit multiplexer block 2006 generates a bitstream.

The incoming signal is coded on a frame-by-frame basis. The input frame size is defined as N in the present embodiment.

Figure 4:
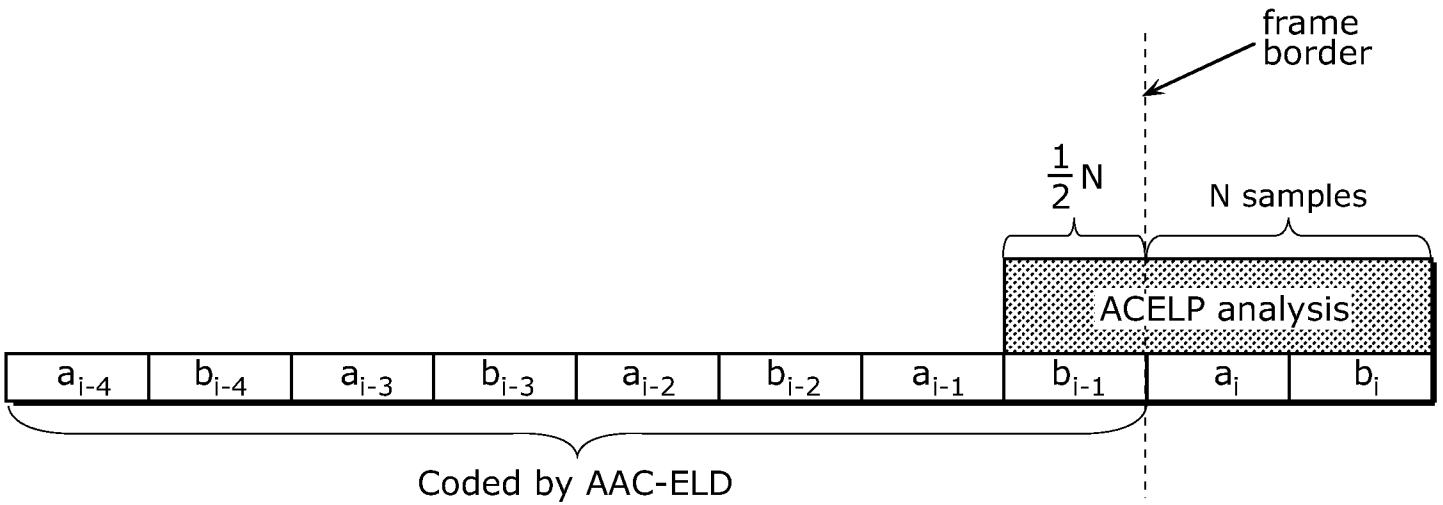
FIG. 4 is a diagram illustrating a frame border when the AAC-ELD mode is switched to the ACELP mode in an encoder.

In FIG. 20, the block switching algorithms 2002 are used to handle the transition frames where the coding mode is switched. FIG. 4 illustrates the block switching algorithm for switching from the AAC-ELD mode to the ACELP mode in Embodiment 1.

The block switching algorithm concatenates the second half of the previous frame i-1 to form an extended frame having a processing frame length of $$\left(N + \frac{1}{2}N\right). \qquad \text{[Math. 18]}$$

This processed frame is sent to the ACELP mode for coding.

Advantageous Effects

The encoder having the block switching algorithm according to the present embodiment facilitates the aliasing cancellation in the decoder when the coding mode is switched from the AAC-ELD mode to the ACELP mode, and realizes a seamless combination of the AAC-ELD coding technology and the ACELP coding technology in the low delay hybrid speech and audio codec having two coding modes of the audio coding mode and the speech coding mode.

Embodiment 2

In Embodiment 2, a hybrid speech and audio encoder having block switching algorithms is invented to code the transition frame where the AAC-ELD mode is switched to the ACELP mode.

As in Embodiment 1, the principle of Embodiment 2 is to extend the frame length of the ACELP frame. The encoder framework is different from Embodiment 1. There are three coding modes in the encoder according to Embodiment 2. They are the AAC-ELD mode, the ACELP mode, and the TCX mode.

Figure 1:
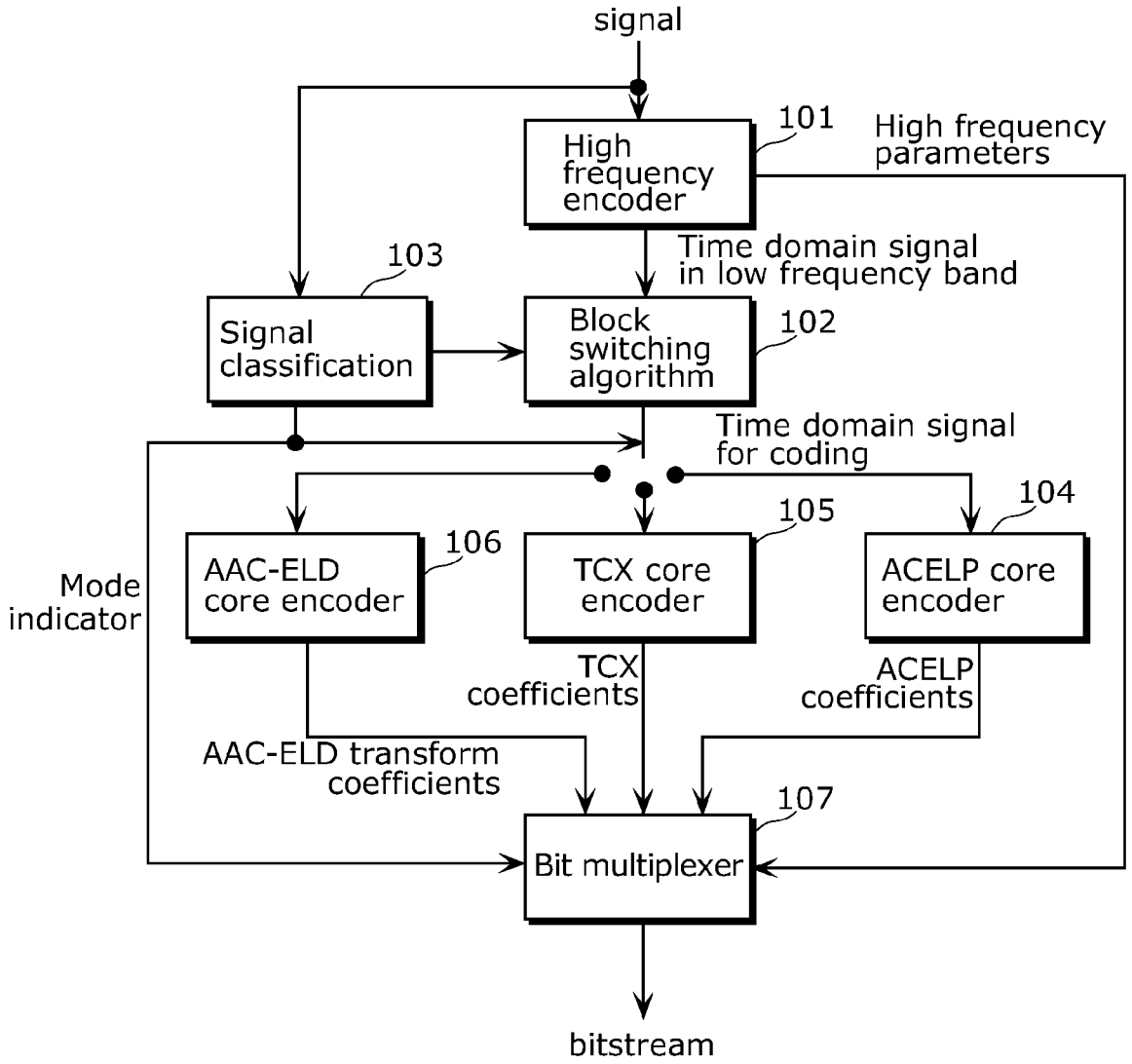
FIG. 1 is a block diagram illustrating a framework of a low delay hybrid encoder having three encoding modes.
Figure 2:
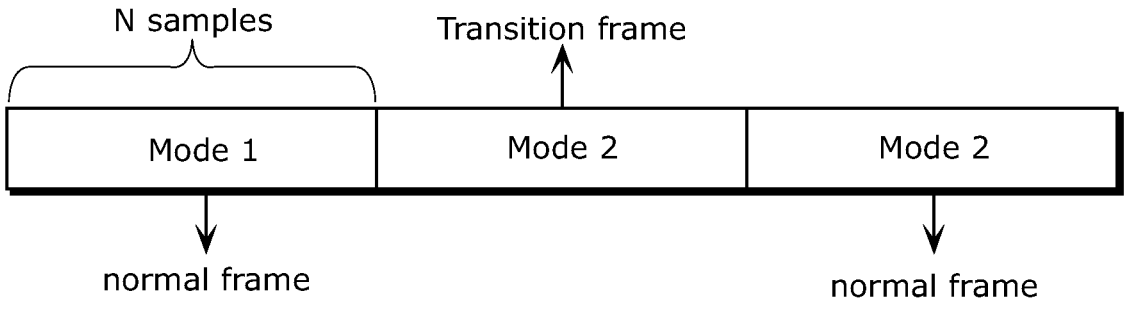
FIG. 2 is a diagram illustrating a transition frame where a normal frame is switched to another normal frame.
Figure 3:
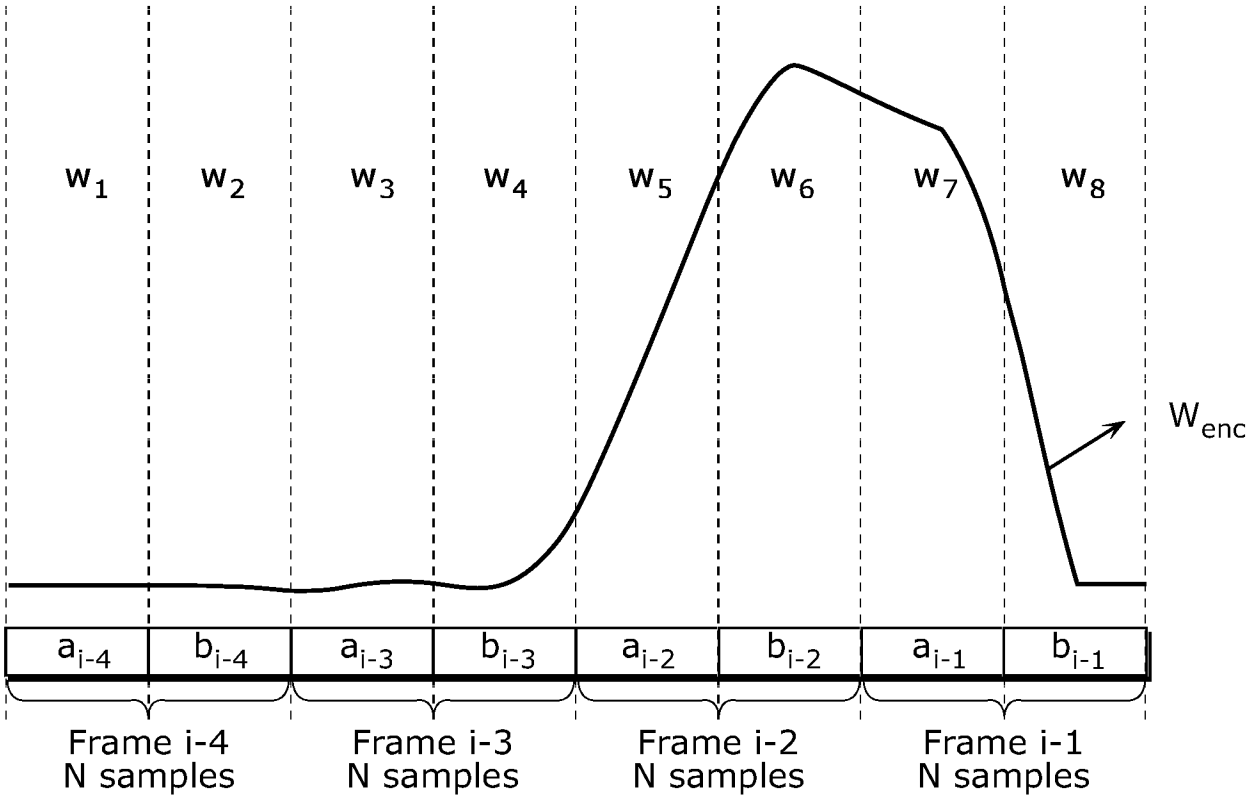
FIG. 3 is a diagram illustrating windowing by an encoder in the AAC-ELD mode.

FIG. 1 illustrates a framework which combines the AAC-ELD that is an audio codec with the ACELP coding technology and the TCX coding technology that are speed codecs. In FIG. 1, an incoming signal is sent to a high frequency encoder 101. The coded high frequency parameters are sent to a bit multiplexer block 107. The incoming signal is also sent to a signal classification block 103. The signal classification decides which coding mode is selected. A mode indicator from the signal classification block is sent to the bit multiplexer block 107. The mode indicator is also used for controlling a block switching algorithm 102. The current time domain signal in low frequency band to be coded is sent to a corresponding encoder 104, 105, 106 according to the mode indicator. The bit multiplexer block 107 generates a bitstream.

Advantageous Effects

The encoder having the block switching algorithm according to the present embodiment facilitates the aliasing cancellation in the decoder when the coding mode is switched from the AAC-ELD mode to the ACELP mode, and realizes a seamless combination of the AAC-ELD coding technology and the ACELP coding technology in the low delay hybrid speech and audio codec having three coding modes.

Embodiment 3

In Embodiment 3, a hybrid speech and audio decoder having block switching algorithms is invented to decode the transition frame where the AAC-ELD mode is switched to the ACELP mode.

In present embodiment, the current frame is denoted as frame i. In order to cancel the aliasing of a frame i-1 introduced by the AAC-ELD coding mode, the block switching algorithms generate the inverse aliasing components using the non-aliasing portion of an ACELP synthesized signal of the frame i and a reconstructed signal of a frame i-2.

Figure 21:
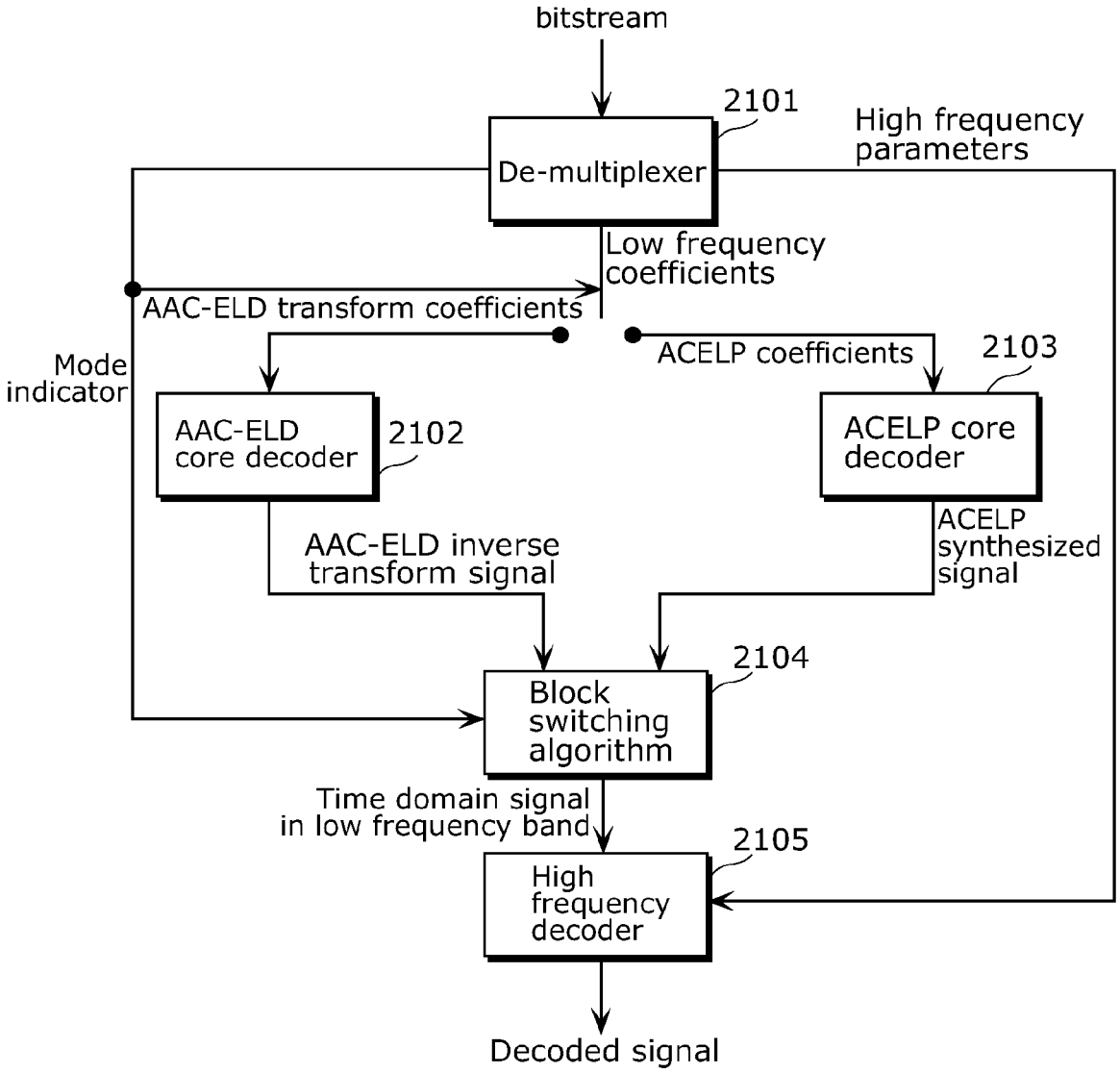
FIG. 21 is a block diagram illustrating a framework of a low delay hybrid decoder having two decoding modes.
Figure 22:
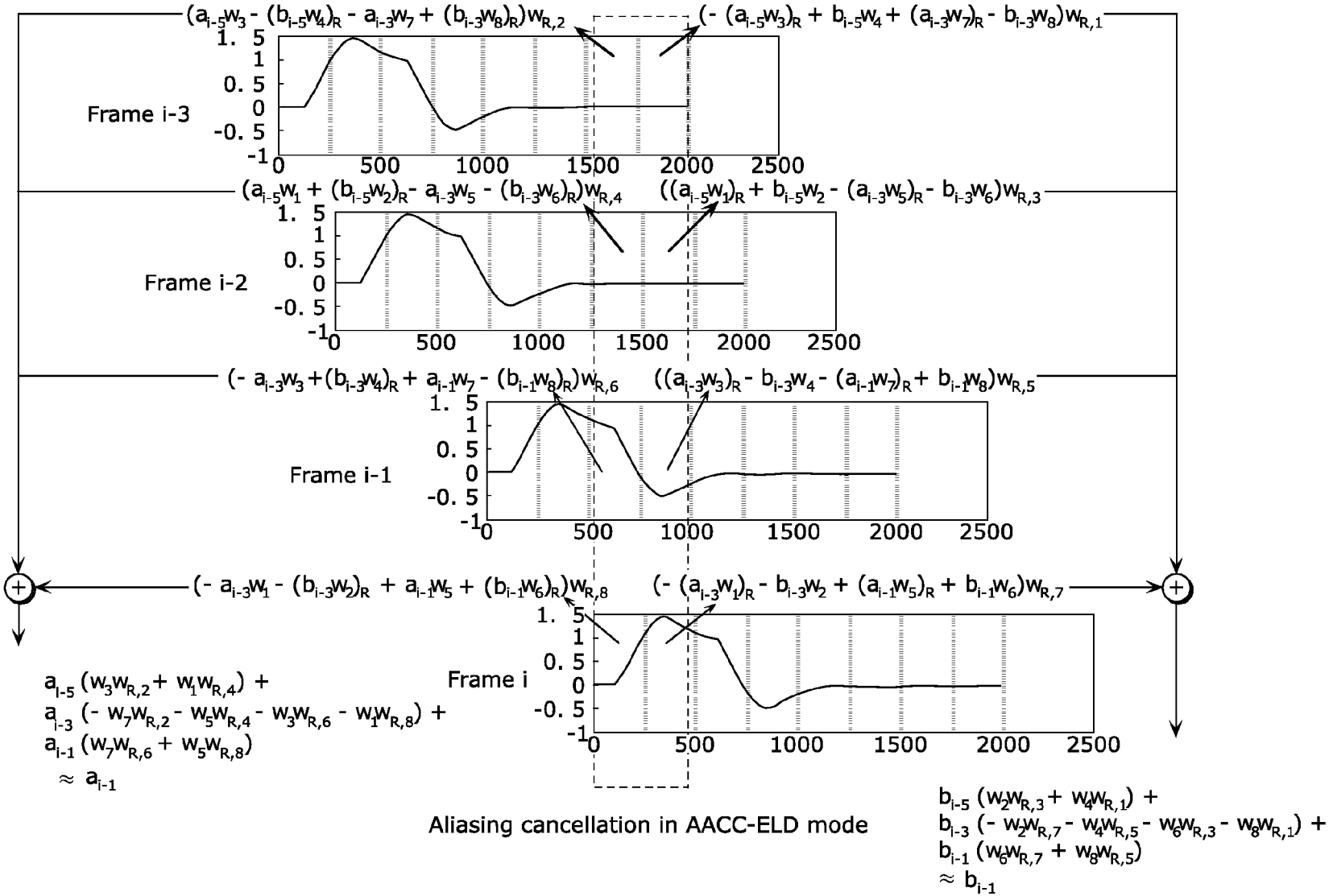
FIG. 22 is a diagram illustrating an aliasing canceling process in the AACC-ELD mode.

FIG. 21 illustrates a hybrid speech and audio decoder which combines the AAC-ELD coding technology with the ACELP decoding technologies. In FIG. 21, an input bitstream is de-multiplexed in 2101. A mode indicator is sent to control the selecting of the decoding mode and the block switching algorithm 2104. High frequency parameters are sent to a high frequency decoder 2105 to reconstruct a high frequency signal. The low frequency coefficients are sent to the corresponding decoder 2102 or 2103 according the mode indicator. The inverse transform signals and the synthesized signals are sent to the block switching algorithm. The block switching algorithm 2104 reconstructs the time domain signal of the low frequency band according to different switching situations. The high frequency decoder 2105 reconstructs the signals base on the high frequency parameters and the time domain signal of the low frequency band.

Figure 23:
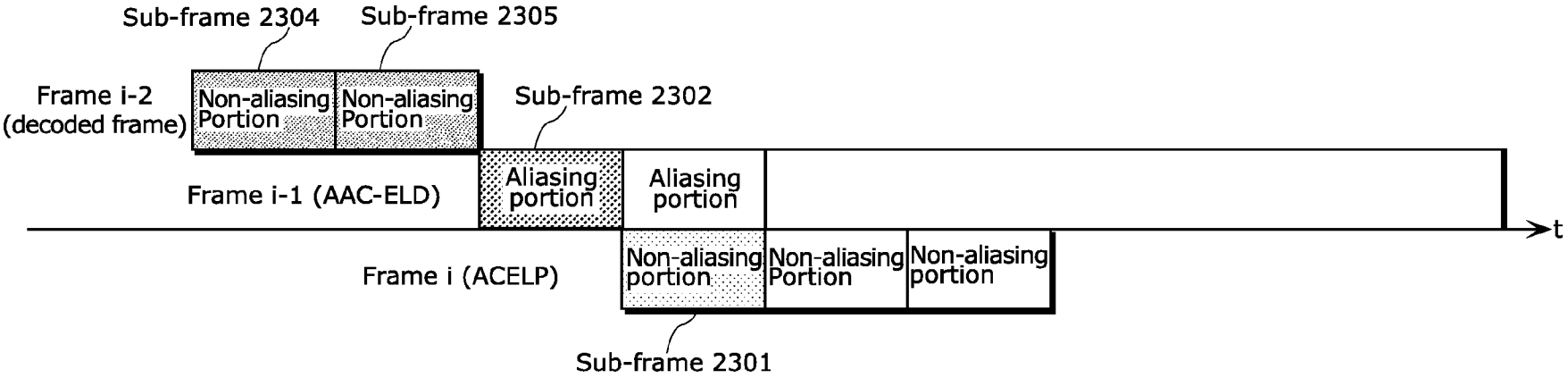
FIG. 23 is a diagram illustrating a process for switching from the AAC-ELD mode to the ACELP mode in a decoder.

In Embodiment 3, a block switching method for switching from the AAC-ELD mode to the ACELP mode in the decoder is invented. FIG. 23 illustrates the transition from the AAC-ELD mode to the ACELP mode. The frame i-1 is inverse transformed in the AAC-ELD mode as a normal frame. The frame i is synthesized in the ACELP mode as a normal frame. The non-aliasing portion denoted as a sub-frame 2301 and the decoded signal of the frame i-2 denoted as a sub-frame 2304 and a sub-frame 2305 are processed and used to cancel the aliasing in the aliasing portion denoted as a sub-frame 2302.

Figure 8:
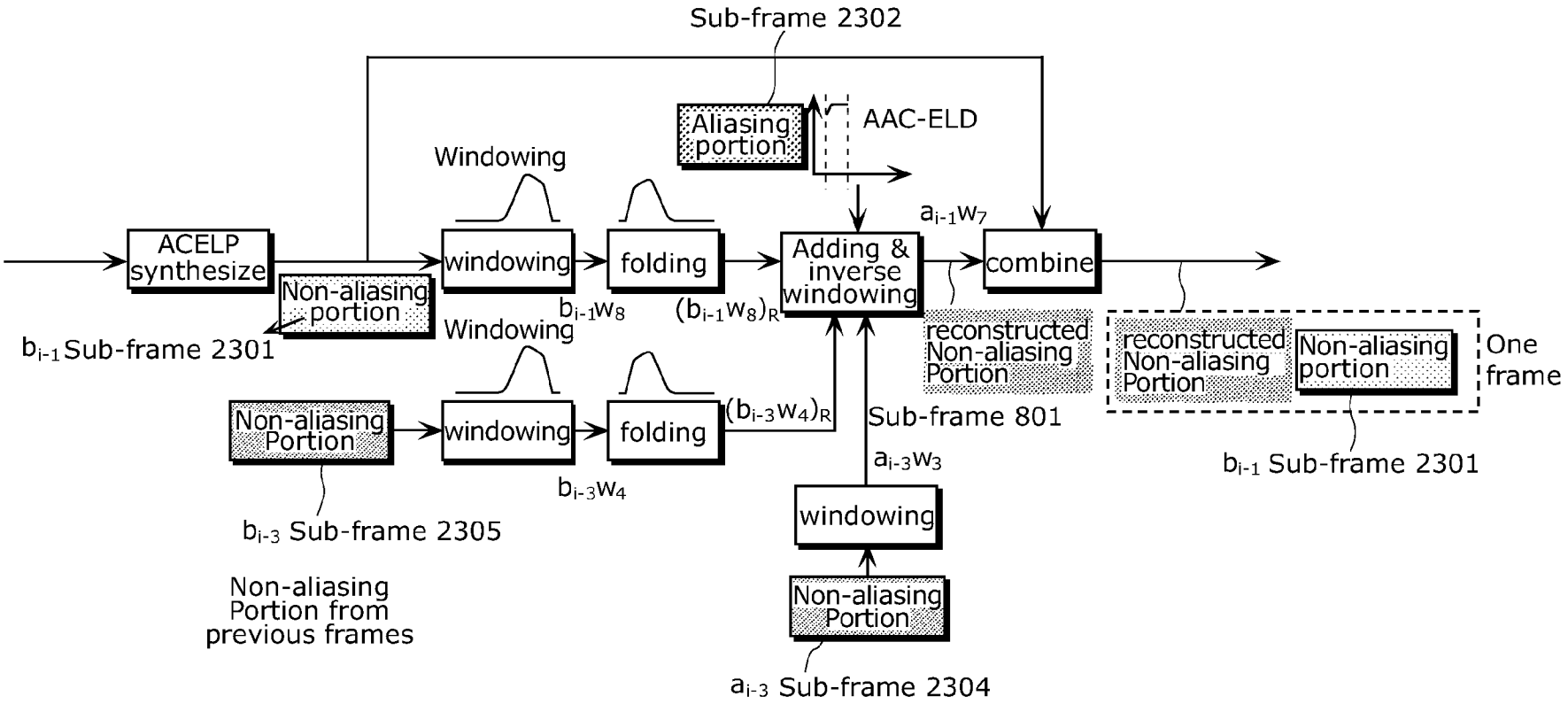
FIG. 8 is a diagram illustrating decoding processes for switching from the AAC-ELD mode to the ACELP mode.

FIG. 8 illustrates one example of the block switching.

For the frame i, the ACELP synthesized signal is denoted as $$y_{i,n}^{acelp},\ 0 \le n < \frac{3}{2}N. \qquad \text{[Math. 19]}$$

According to the encoding processes illustrated in Embodiment 1, the length of the ACELP synthesized signal is $$3/2N, \qquad \text{[Math. 20]}$$

A part of the non-aliasing portion, denoted as the sub-frame 2301 in FIG. 23, is extracted for aliasing cancellation:

$$b_{i-1} = y_{i,n}^{acelp},\ 0 \le n < \frac{1}{2}N \qquad \text{[Math. 21]}$$

The AAC-ELD inverse transform signals of the previous frame i-1 are denoted as $y_{i-1}$ with a length of 4N. One aliasing portion denoted as the sub-frame 2302 in FIG. 23 is extracted and expressed as follows according to the AAC-ELD inverse transform explained in the background section:

$$-a_{i-3}w_3+(b_{i-3}w_4)_R+a_{i-1}w_7-(b_{i-1}w_8)_R \qquad \text{[Math. 22]}$$

The non-aliasing portion 2301 ($b_{i-1}$), the aliasing portion 2302 ($-a_{i-3}w_3+(b_{i-3}w_4)_R+a_{i-1}w_7-(b_{i-1}w_8)_R$) of the frame i-1, and the sub-frames 2304 and 2305 that are the reconstructed signal of the frame i-2 [$a_{i-3}$, $b_{i-3}$] are used for reconstructing the signal of the transition frame.

The window $w_8$ is applied to the non-aliasing portion $b_{i-1}$, as shown in FIG. 8, to obtain $b_{i-1}w_8$.

After windowing, folding is applied to obtain the reverse order of $b_{i-1}w_8$, denoted as $(b_{i-1}w_8)_R$.

The window $w_3$ is applied to the non-aliasing portion $a_{i-3}$ to obtain $a_{i-3}w_3$, as shown in FIG. 8.

The window $w_4$ is applied to the non-aliasing portion $b_{i-3}$ to obtain $b_{i-3}w_4$, as shown in FIG. 8. The reverse order of $b_{i-3}w_4$ is obtained as shown in 901, and is denoted as $(b_{i-3}w_4)_R$.

To cancel the aliasing, components $-a_{i-3}w_3+(b_{i-3}w_4)_R+a_{i-1}w_7-(b_{i-1}w_8)_R$, $(b_{i-1}w_8)_R$, $a_{i-3}w_3$, and $(b_{i-3}w_4)_R$ are added as shown in FIG. 8.

Inverse windowing is applied to $a_{i-1}w_7$ to obtain $a_{i-1}$:

$$a_{i-1}=a_{i-1}w_7/7$$

Therefore, the outputs of the frame i are signals [$a_{i-1}$, $b_{i-1}$] reconstructed by concatenation of the sub-frame 2301 and the sub-frame 801.

Advantageous Effects

As explained above, the decoder according to the present embodiment having the block switching algorithm can cancel the aliasing introduced in the transition frame where the AAC-ELD mode is switched to the ACELP mode, by performing signal processing using the non-aliasing portion of the previous frame. This enables a seamless combination of the AAC-ELD coding technology and the ACELP coding technology in the low delay hybrid decoder having two decoding modes.

Embodiment 4

In Embodiment 4, a hybrid speech and audio decoder having block switching algorithms is invented to decode the transition frame where the AAC-ELD mode is switched to the ACELP mode.

The principle of Embodiment 4 is the same as Embodiment 3. The decoder framework is different from Embodiment 3. There are three decoding modes in the decoder of Embodiment 4. They are the AAC-ELD decoding mode, the ACELP decoding mode, and the TCX decoding mode.

Figure 5:
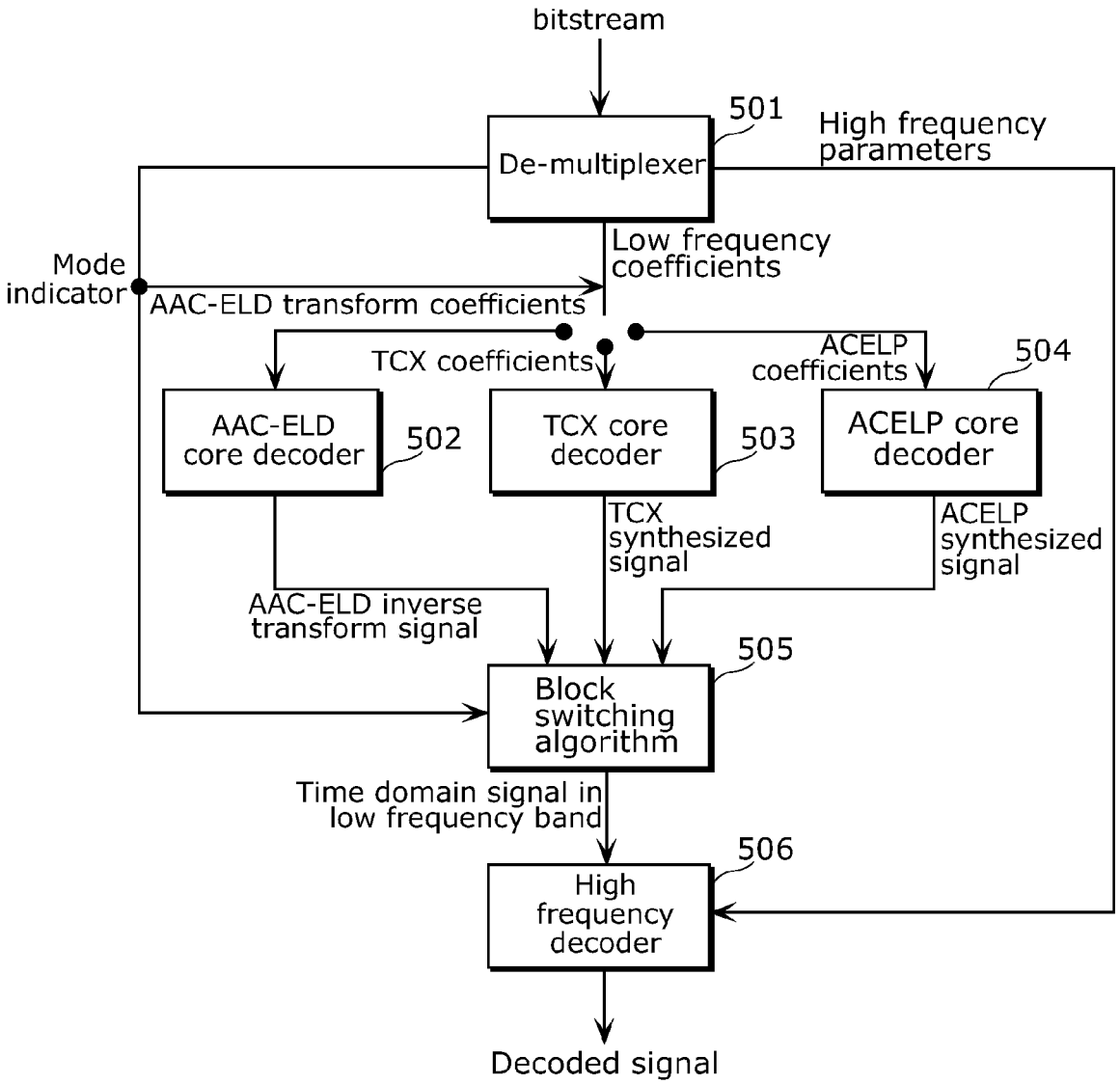
FIG. 5 is a block diagram illustrating a low delay hybrid decoder having three decoding modes.
Figure 6:
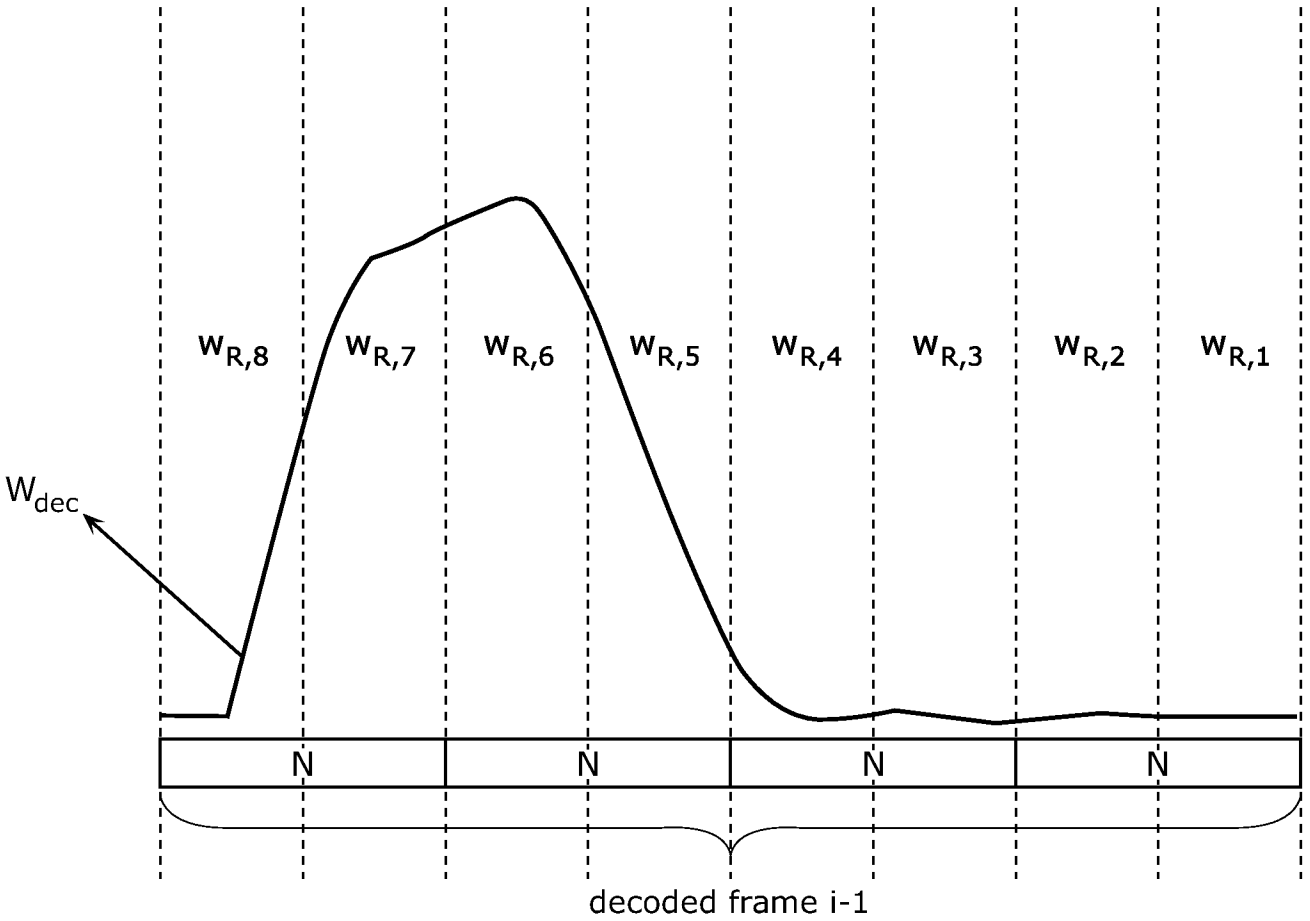
FIG. 6 is a diagram illustrating windowing by a decoder in the AAC-ELD mode.
Figure 7:
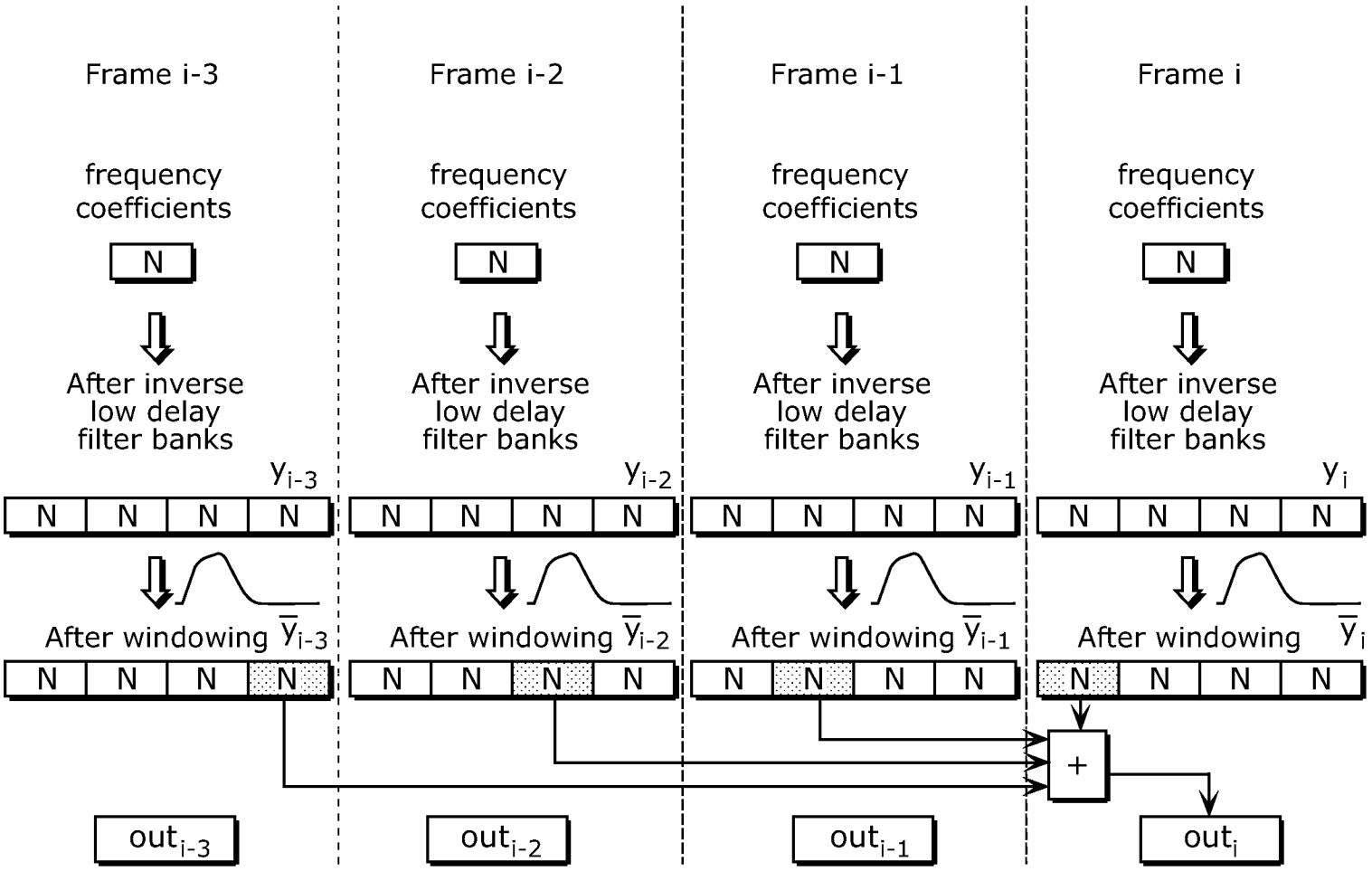
FIG. 7 is a diagram illustrating decoding processes in the AAC-ELD mode.

FIG. 5 illustrates the hybrid speech and audio decoder which combines the AAC-ELD coding technology with the ACELP and TCX coding technologies. In FIG. 5, the input bitstream is de-multiplexed in 501. A mode indicator is sent to control the selecting one from decoders 502, 503, and 504 and is sent to a block switching algorithm 505. The high frequency parameters are sent to a high frequency decoder 506 to reconstruct a high frequency signal. The low frequency coefficients are sent to the corresponding decoding mode according the mode indicator. The inverse transform signals and synthesized signals are sent to the block switching algorithm 505. The block switching algorithm 505 reconstructs the time domain signal of the low frequency band according to different switching situations. The high frequency decoder 506 reconstructs the signals base on the high frequency parameters and the time domain signal of the low frequency band.

Advantageous Effects

The decoder having the block switching algorithm according to the present embodiment solves the aliasing cancellation problem at the transition frame where AAC-ELD mode is switched to the ACELP mode, and realizes a seamless combination of the AAC-ELD coding technology and the ACELP coding technology in the low delay hybrid codec having three decoding modes.

Embodiment 5

In Embodiment 5, a hybrid speech and audio encoder having block switching algorithm is invented to code the transition frame where the ACELP mode is switched to the AAC-ELD mode.

When the coding mode is switched from the ACELP mode to the AAC-ELD mode, the decoding process switches back to the normal AAC-ELD overlapping and adding process. In prior art, this transition frame is coded by normal AAC-ELD low delay filter banks. In contrast to the prior art, the encoder of the present embodiment uses MDCT filter banks. An advantageous effect of the method of the present embodiment is that it reduces the computation complexity of the coding operation compared to the AAC-ELD coding. By using the method of the present embodiment, the transform coefficients being sent to the decoder are reduced to half compared to the normal AAC-ELD mode. Thus, the bitrate is saved.

The encoder framework is the same as Embodiment 1. The block switching method in the present embodiment is different from Embodiment 1. The present embodiment is to code the transition frame where the ACELP mode is switched to the AAC-ELD mode.

Figure 10:
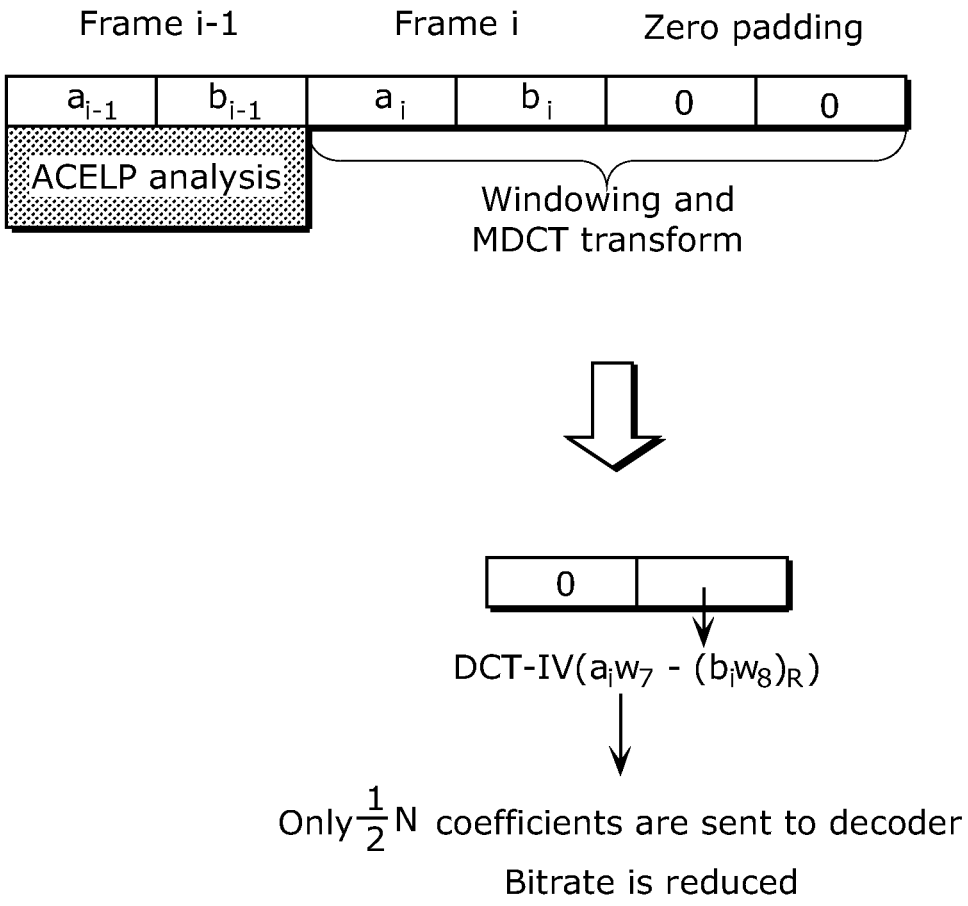
FIG. 10 is a diagram illustrating a process for switching from the ACELP mode to the AAC-ELD mode in an encoder.

FIG. 10 illustrates the coding method for the transition frame according to the present embodiment. The current frame i $[a_i, b_i]$ is extended to the length of 2N by zero padding, denoted as $[a_i, b_i, 0, 0]$. Windowing is applied to this vector to obtain a vector $[a_i w_7, b_i w_8, 0, 0]$.

After windowing, MDCT filter banks are used to transform the windowed vector:

$$\bar{y}_k^{MDCT} = \sum_{n=0}^{2N-1} \bar{X}_n^{MDCT} \cos\left[\frac{\pi}{N}\left(n + \frac{1}{2} + \frac{N}{2}\right)\left(k + \frac{1}{2}\right)\right], \quad 0 \le k < N. \qquad \text{[Math. 23]}$$

The MDCT transform coefficients can be expressed in terms of DCT-IV as follows:

$$[0, DCT\text{-}IV(a_i w_7 - (b_i w_8)_R)]$$

As a result, the coefficients of the portion N/2 are all zero, and thus only the DCT-IV $(a_i w_7 - (b_i w_8)_R)$ having the length of N/2 needs to be sent to the decoder. The length of the AAC-ELD coefficients is N. Therefore, by using the method according to the present embodiment, the bitrate is saved by half.

Advantageous Effects

The encoder according to the present embodiment having the block switching algorithm helps prepare the aliasing components of the frame i in order to perform aliasing cancellation with following frames coded in the AAC-ELD mode, when the coding mode is switched from the ACELP mode to the AAC-ELD mode. It reduces the computation complexity of the coding operation and reduces the bitrate compared to when using the AAC-ELD mode on the transition frame directly.

Embodiment 6

In Embodiment 6, a hybrid speech and audio encoder having a block switching algorithm is invented to code the transition frame where the ACELP mode is switched to the AAC-ELD mode.

The principle of Embodiment 6 is the same as Embodiment 5, but the encoder framework is different from Embodiment 5.

There are three coding modes in the encoder of Embodiment 6, namely the AAC-ELD mode, the ACELP mode, and the TCX mode. The encoder frame work of Embodiment 6 is the same as Embodiment 2.

Embodiment 7

In Embodiment 7, a hybrid speech and audio decoder with block switching algorithms is invented to decode the transition frame where the ACELP mode is switched to the AAC-ELD mode.

Figure 9:
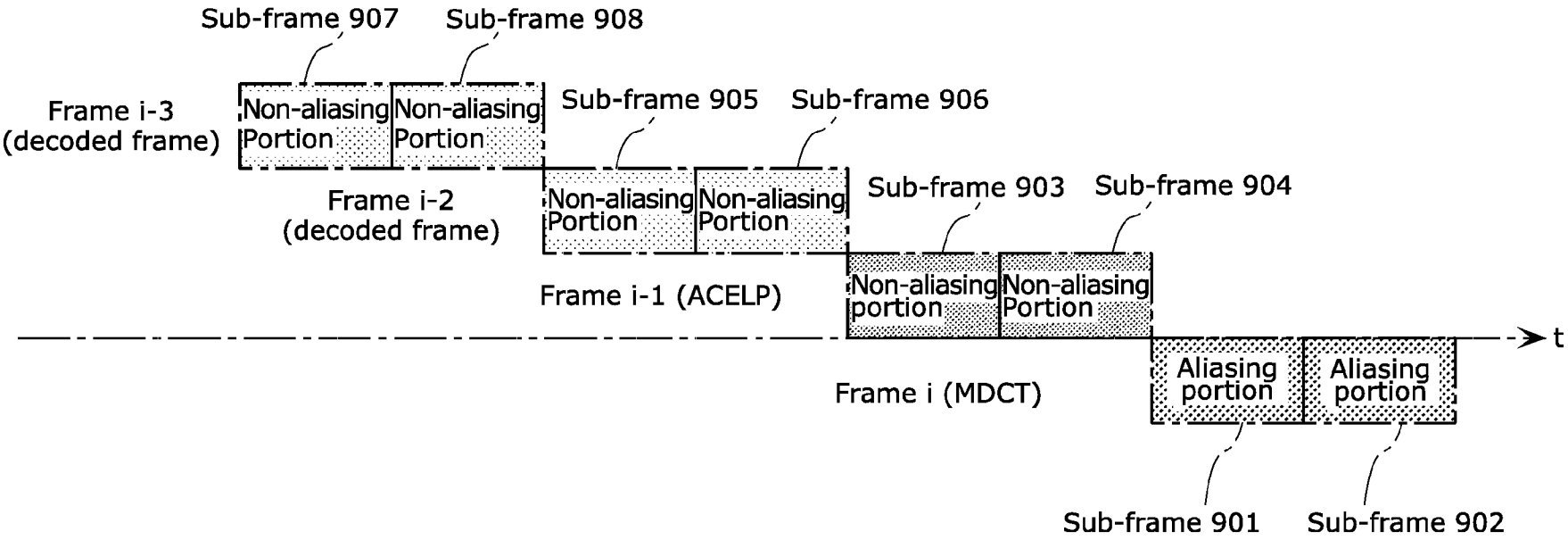
FIG. 9 is a diagram illustrating a process for switching from the ACELP mode to the AAC-ELD mode in a decoder.

In the present embodiment, block switching in the decoder from the ACELP mode to the AAC-ELD mode is performed according to the encoder in Embodiment 5. When the coding mode is switched from the ACELP mode to the AAC-ELD mode, the following frames are switched back to the AAC-ELD overlapping and adding mode. Aliasing of the AAC-ELD are produced by using the aliasing portions of the inverse MDCT transform signal of the frame i, the non-aliasing portion of the ACELP synthesized signal of the frame i-1, and the reconstructed signal of the frame i-2 and the frame i-3. FIG. 9 illustrates the transition from the ACELP mode to the AAC-ELD mode in the decoder.

Figure 11:
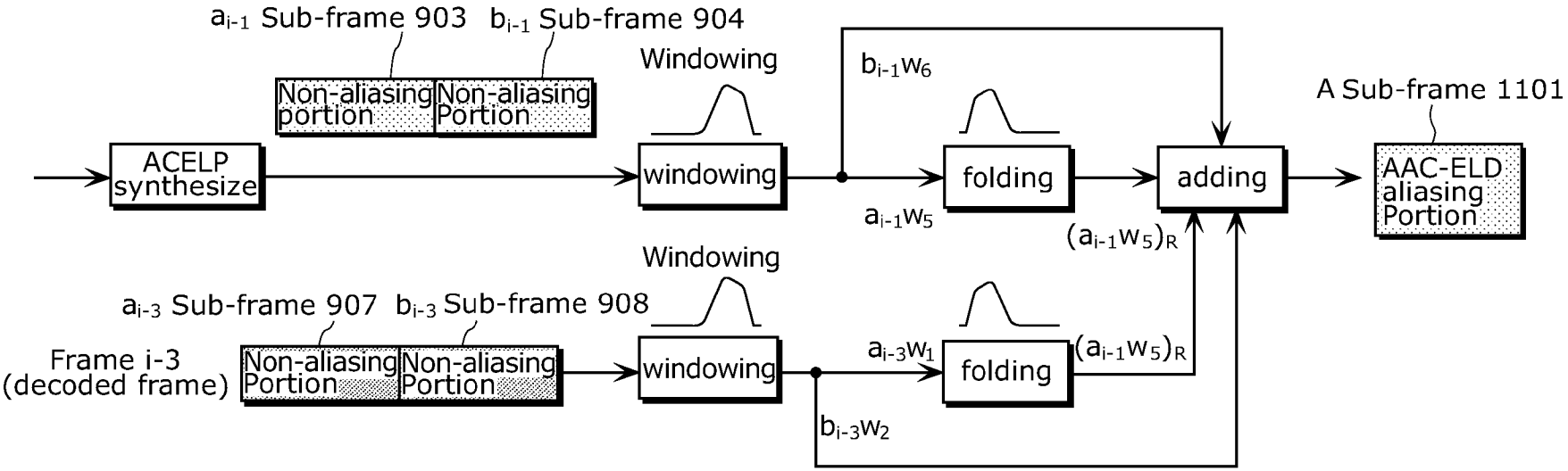
FIG. 11 is a diagram illustrating Example 1 of decoding processes for switching from the ACELP mode to the AAC-ELD mode.
Figure 12:
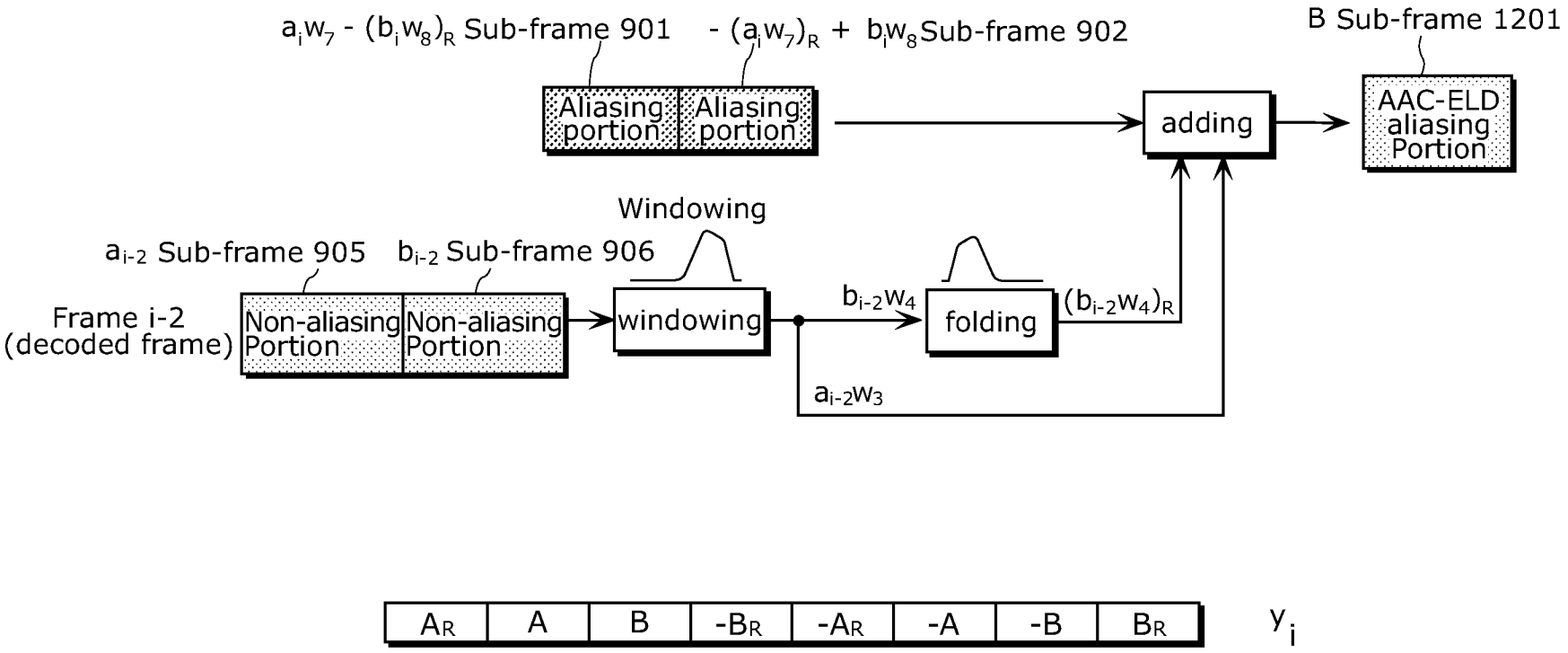
FIG. 12 is a diagram illustrating Example 2 of decoding processes for switching from the ACELP mode to the AAC-ELD mode.

The decoder framework is the same as Embodiment 3. The block switching method in the present embodiment is different from Embodiment 3. FIGS. 9, 11, and 12 illustrate one example of the decoding processes.

According to Embodiment 5, the received low band coefficients are MDCT transform coefficients DCT-IV $(a_i w_7 -$ $(b_i w_8)_R$) in this transition frame i. Therefore, the corresponding inverse filter banks are IMDCT in Embodiment 7. The aliasing outputs of the IMDCT are denoted as $[a_i w_7-(b_i w_8)_R, -(a_i w_7)_R+b_i w_8]$ having a length of N, shown as a sub-frame 901 and a sub-frame 902 in FIG. 9.

The non-aliasing portions of ACELP synthesized signals from the previous frame i-1 are denoted as $[a_{i-1}, b_{i-1}]$ having a length of N, shown as a sub-frame 903 and a sub-frame 904 in FIG. 9.

The outputs of the previous two frames are denoted as $[a_{i-2}, b_{i-2}]$ and $[a_{i-3}, b_{i-3}]$, shown as sub-frames 905, 906, 907, and 908, respectively in FIG. 9.

The aliasing portions of the inverse AAC-ELD are produced by using the sub-frames mentioned above. The purpose is to prepare the aliasing components for overlapping and adding with the following frames coded in the AAC-ELD mode, so that the coding mode can switch back to the normal AAC-ELD mode.

One of the methods to generate the aliasing components introduced by inverse low delay filter banks is described in the following section. FIGS. 11 and 12 illustrate the detail processes of how to produce the aliasing elements of the AAC-ELD.

In FIG. 11, the decoded signal $a_{i-3}$ of a frame i-3 is windowed to obtain $a_{i-3}w_1$. Folding is applied to obtain the reverse order $(a_{i-3}w_1)_R$.

The second half of the decoded signal $b_{i-3}$ of the frame i-3 is windowed to obtain $b_{i-3}w_2$.

The first part of the non-aliasing portion of the ACELP synthesized signal $a_{i-1}$ of the frame i-1 is windowed to obtain $a_{i-1}w_5$. Folding is applied to obtain the reverse order $(a_{i-1}w_5)_R$.

The second part of the non-aliasing portion of the ACELP synthesized signal is denoted as $b_{i-1}$. Windowed is applied to $b_{i-1}$ to obtain $b_{i-1}w_6$.

By adding up the vectors $(a_{i-3}w_1)_R$, $b_{i-3}w_2$, $(a_{i-1}w_5)_R$, and $b_{i-1}w_6$, the aliasing components of inversed low delay filter banks coefficients $y_i$ are reconstructed as follows:

$$A=-(a_{i-3}w_1)_R-b_{i-3}w_2+(a_{i-1}w_5)_R+b_{i-1}w_6$$

$$A_R=-a_{i-3}w_1-(b_{i-3}w_2)_R+a_{i-1}w_5+(b_{i-1}w_6)_R$$

$$-A_R=a_{i-3}w_1+(b_{i-3}w_2)_R-a_{i-1}w_5-(b_{i-1}w_6)_R$$

$$-A=(a_{i-3}w_1)_R+b_{i-3}w_2-(a_{i-1}w_5)_R-b_{i-1}w_6 \quad \text{[Math. 24]}$$

By using the same analytical method, the rest of the components of the inversed transform coefficients $y_i$ is reconstructed. FIG. 12 illustrates the detail of the processes of producing the aliasing portions of the AAC-ELD.

$$B=-a_{i-2}w_3+(b_{i-2}w_4)_R+a_iw_7-(b_iw_8)_R$$

$$-B_R=(a_{i-2}w_3)_R-b_{i-2}w_4-(a_iw_7)_R+b_iw_8$$

$$-B=a_{i-2}w_3-(b_{i-2}w_4)_R-a_iw_7+(b_iw_8)_R$$

$$B_R=-(a_{i-2}w_3)_R+b_{i-2}w_4+(a_iw_7)_R-b_iw_8 \quad \text{[Math. 25]}$$

The aliasing portions of the AAC-ELD frame i are obtained, as shown in FIG. 12.

$$y_i=[A_R,A,B,-B_R,-A_R,-A,-B,B_R] \quad \text{[Math. 26]}$$

Decoder window $[w_{R,8}, w_{R,7}, w_{R,6}, w_{R,5}, w_{R,4}, w_{R,3}, w_{R,2}, w_{R,1}]$ is applied to obtain the windowed aliasing portions:

$$\bar{y}_i \quad \text{[Math. 27]}$$

$$\bar{y}_i=$$

$$[(-a_{i-3}w_1-(b_{i-3}w_2)_R+a_{i-1}w_5+(b_{i-1}w_6)_R)w_{R,8},$$

$$(-(a_{i-3}w_1)_R-b_{i-3}w_2+(a_{i-1}w_5)_R+b_{i-1}w_6)w_{R,7},$$

$$(-a_{i-2}w_3+(b_{i-2}w_4)_R+a_iw_7-(b_iw_8)_R)w_{R,6},$$

$$((a_{i-2}w_3)_R-b_{i-2}w_4-(a_iw_7)_R+b_iw_8)w_{R,5},$$

$$(a_{i-3}w_1+(b_{i-3}w_2)_R-a_{i-1}w_5-(b_{i-1}w_6)_R)w_{R,4},$$

$$((a_{i-3}w_1)_R-b_{i-3}w_2-(a_{i-1}w_5)_R-b_{i-1}w_6)w_{R,3},$$

$$(a_{i-2}w_3-(b_{i-2}w_4)_R-a_iw_7+(b_iw_8)_R)w_{R,2},$$

$$(-(a_{i-2}w_3)_R+b_{i-2}w_4+(a_iw_7)_R-b_iw_8)w_{R,1}] \quad \text{[Math. 28]}$$

With the re-generated aliasing portions of the AAC-ELD, the aliasing cancellation with following AAC-ELD frames can be continued.

Advantageous Effects

The decoder according to the present embodiment having the block switching algorithm generates the aliasing components of the AAC-ELD mode using the MDCT coefficients, to facilitate the aliasing cancellation with the following frames coded in the AAC-ELD mode. According to an aspect of the present invention, it is possible to realize a seamless transition from the ACELP mode to the AAC-ELD mode in the low delay hybrid speech and audio codec having two coding modes.

Embodiment 8

In Embodiment 8, a hybrid speech and audio decoder having block switching algorithms is invented to decode the transition frame where the ACELP mode is switched to the AAC-ELD mode.

The principle of Embodiment 8 is the same as Embodiment 7. The decoder framework is different from Embodiment 7.

There are three decoding modes in Embodiment 8, namely the AAC-ELD mode, the ACELP mode, and the TCX mode. The frame work of Embodiment 8 is the same as Embodiment 4.

Advantageous Effects

The decoder according to the present embodiment having the block switching algorithm generates the aliasing of the AAC-ELD mode to facilitate the aliasing cancellation with the following frames coded in the AAC-ELD mode. According to an aspect of the present invention, it is possible to realize a seamless transition from the ACELP mode to the AAC-ELD mode in the low delay hybrid speech and audio codec having three coding modes.

Embodiment 9

In Embodiment 9, a speech and audio encoder having a block switching algorithm is invented to code the transition frame where the AAC-ELD mode is switched to the TCX mode.

In order to cancel previous frame's aliasing introduced by the AAC-ELD mode in the decoder, the TCX frame size is extended. In the present embodiment, the block switching algorithms concatenate the current frame with the previous frame to form an extended frame, whose length is longer than the normal frame size. This extended frame is coded in the TCX mode in the encoder.

The encoder frame work is the same as Embodiment 2. The block switching method in the present embodiment is different from Embodiment 2. The present embodiment is to code the transition frame where the AAC-ELD mode is switched to the TCX mode.

Figure 13:
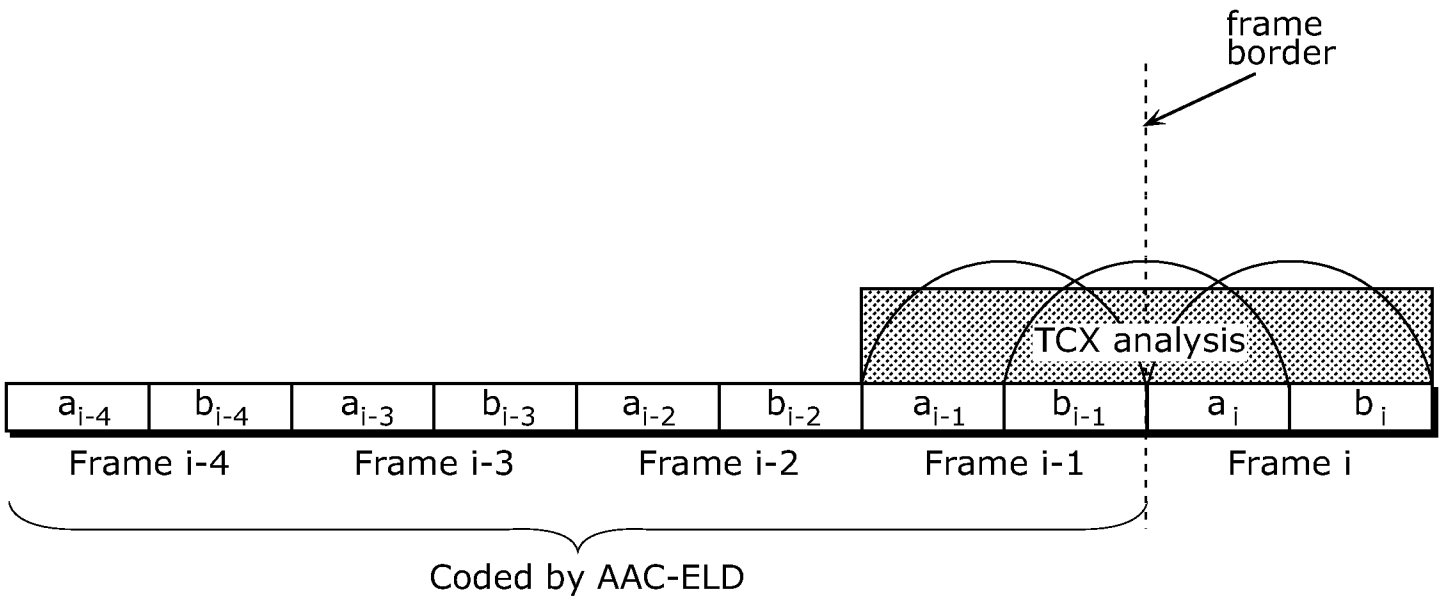
FIG. 13 is a diagram illustrating a process for switching from the AAC-ELD mode to the TCX mode in an encoder.

FIG. 13 illustrates the coding process. The previous frame is coded in the AAC-ELD mode. In order to cancel the aliasing of the previous frame i-1 introduced by the AAC-ELD mode, the current frame i is concatenated with the previous frame i-1 to form a long frame. The processing frame size is 2N, where N is the frame size. The extended frame is coded in the TCX mode as shown in FIG. 13.

The window size of the TCX mode is N. The overlapping length of the TCX mode is $$\tfrac{1}{2}N, \qquad \text{8 Math. 29]}$$

Therefore, the extended frame contains three TCX windows as shown in FIG. 13.

Advantageous Effects

The encoder according to the present embodiment having the block switching algorithm facilitates the aliasing cancellation in the decoder when the coding mode is switched from the AAC-ELD mode to the TCX mode, and realizes a seamless combination of the AAC-ELD coding technology and the TCX coding technology in the low delay hybrid speech and audio codec having three coding modes.

Embodiment 10

In Embodiment 10, a hybrid speech and audio decoder having a block switching algorithm is invented to decode the transition frame where the AAC-ELD mode is switched to the TCX mode.

In present embodiment, the current frame is denoted as the frame i. In order to cancel the aliasing of the frame i-1 introduced by the AAC-ELD mode, the block switching algorithm generates the inverse aliasing components using the TCX synthesized signal of the frame i and the reconstructed signal of the frame i-2.

Figure 14:
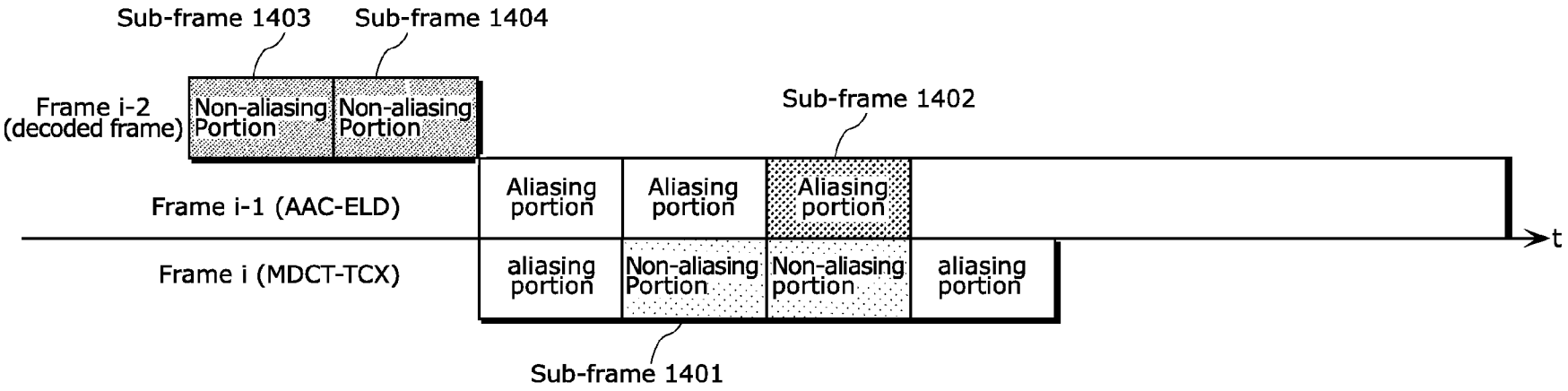
FIG. 14 is a diagram illustrating a process for switching from the AAC-ELD mode to the TCX mode in a decoder.

The decoder framework is the same as Embodiment 4. The block switching method in the present embodiment is different from Embodiment 4. FIG. 14 illustrates the block switching process.

According to Embodiment 9, the current transition frame is coded in the TCX mode using a processing frame size of 2N, where N is the frame size. According to the encoder in Embodiment 9, the TCX synthesis is used to synthesize in the decoder. The TCX synthesized signals are $[a_{i-1}+\text{aliasing}, b_{i-1}, a_i, b_i+\text{aliasing}]$ with a length of 2N. The non-aliasing portion $b_{i-1}$, shown as a sub-frame 1401 in FIG. 14, is used for generation the aliasing component of a sub-frame 1402.

The AAC-ELD synthesized signals of the previous frame i-1 is denoted as $y_{i-1}$, and has a length of 4N. According to the AAC-ELD inverse transform described in the background section, the $y_{i-1}$ is shown as follows:

$$y_{i-1}=$$

$$[-a_{i-4}w_1-(b_{i-4}w_2)_R+a_{i-2}w_5+(b_{i-2}w_6)_R,$$

$$-(a_{i-4}w_1)_R-b_{i-4}w_2+(a_{i-2}w_5)_R+b_{i-2}w_6,$$

$$-a_{i-3}w_3+(b_{i-3}w_4)_R+a_{i-1}w_7-(b_{i-1}w_8)_R,$$

$$(a_{i-3}w_3)_R-b_{i-3}w_4-(a_{i-1}w_7)_R+b_{i-1}w_8,$$

$$a_{i-4}w_1+(b_{i-4}w_2)_R-a_{i-2}w_5-(b_{i-2}w_6)_R,$$

$$(a_{i-4}w_1)_R+b_{i-4}w_2-(a_{i-2}w_5)_R-b_{i-2}w_6,$$

$$a_{i-3}w_3-(b_{i-3}w_4)_R-a_{i-1}w_7+(b_{i-1}w_8)_R,$$

$$-(a_{i-3}w_3)_R+b_{i-3}w_4+(a_{i-1}w_7)_R-b_{i-1}w_8] \qquad \text{[Math. 30]}$$

The AAC-ELD aliasing component $-a_{i-3}w_3+(b_{i-3}w_4)_R+a_{i-1}w_7-(b_{i-1}w_8)_R$, shown as the sub-frame 1402, is cancelled by using the TCX synthesized signal $b_{i-1}$ of the sub-frame 1401, and the reconstructed signal $out_{i-2}=[a_{i-3}, b_{i-3}]$ of the frame i-2, shown as sub-frame 1403 and 1040. The transition frame is reconstructed.

The details of the aliasing cancellation processes in FIG. 14 are the same as the description of FIG. 8. The sub-frame 2301 in FIG. 23 is replaced by the non-aliasing portion $b_{i-1}$ of the sub-frame 1401. The sub-frame 2302 that is the aliasing portion is replaced by 1402 in FIG. 14. The non-aliasing portion, denoted as sub-frames 2304 and 2305 are replaced by $out_{i-2}=[a_{i-3}, b_{i-3}]$, denoted as sub-frames 1403 and 1404 in FIG. 14. The reconstructed signal of the transition frame i is $[a_{i-1}, b_{i-1}]$.

Advantageous Effects

The decoder according to the present embodiment having the block switching algorithm cancels the aliasing of the frame i-1 introduced by the AAC-ELD mode. This enables a seamless transition from the AAC-ELD mode to the TCX mode in the low delay hybrid speech and audio codec.

Embodiment 11

In Embodiment 11, a hybrid speech and audio encoder having a block switching algorithm is invented to code the transition frame where the TCX mode is switched to the AAC-ELD mode.

The current transition frame is denoted as the frame i and it is coded in the AAC-ELD mode. The previous frame is coded in the TCX mode. In order to cancel the aliasing of the frame i introduced by the AAC-ELD low delay filter banks, the block switching algorithm codes the current frame together with three previous frames in the AAC-ELD mode.

The encoder framework is the same as Embodiment 2. The block switching method in the present embodiment is different from Embodiment 2.

Figure 15:
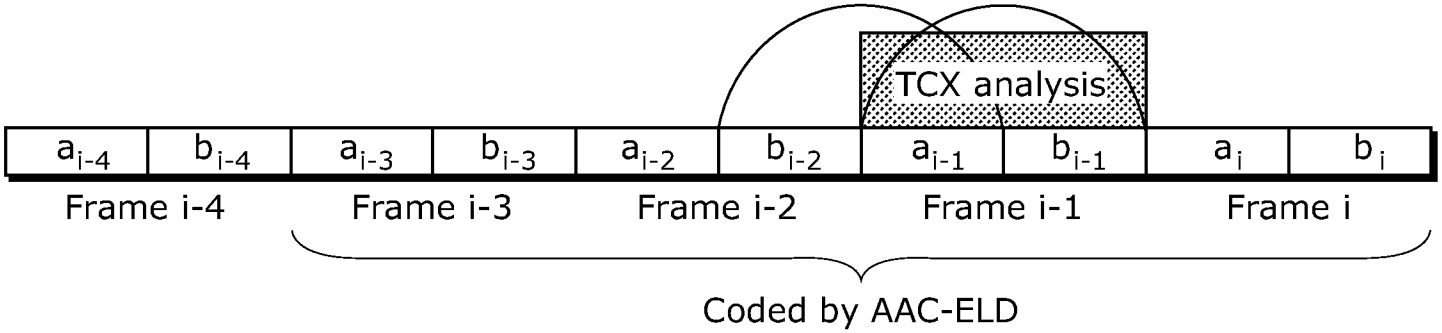
FIG. 15 is a diagram illustrating a process for switching from the TCX mode to the AAC-ELD mode in an encoder.

FIG. 15 illustrates the coding process for the transition frame where the TCX mode is switched to the AAC-ELD mode in the encoder. According to Embodiment 9, the length of overlapping, in the TCX mode, is $$\tfrac{1}{2}N \qquad \text{[Math. 31]}$$

where N is the frame size. For a frame coded in the normal TCX mode, two TCX windows are applied as shown in FIG. 15.

For the current transition frame, the AAC-ELD mode is directly applied as shown in FIG. 15.

Advantageous Effects

The encoder in Embodiment 11 facilitates the aliasing cancelling performed in the decoder when the TCX mode is switched to the AAC-ELD mode. The block switching algorithm in the present embodiment realizes the seamless combination of the AAC-ELD coding technology and the TCX coding technology in the low delay hybrid speech and audio codec.

Embodiment 12

In Embodiment 12, a hybrid speech and audio decoder having a block switching algorithm is invented to decode the transition frame where the TCX mode is switched to the AAC-ELD mode.

The block switching algorithm in the present embodiment generates the aliasing of the AAC-ELD using the TCX synthesized signals and the reconstructed signal of the frame i-2, and cancels the aliasing of the AAC-ELD for the block switching purpose.

Figure 16:
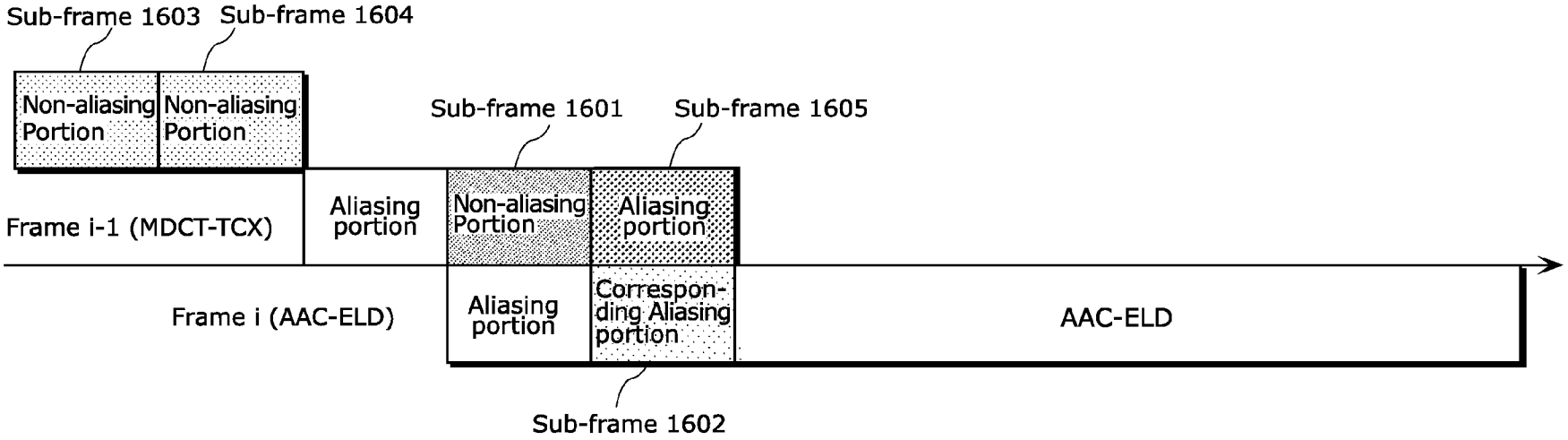
FIG. 16 is a diagram illustrating a decoding process for switching from the TCX mode to the AAC-ELD mode.

FIG. 16 illustrates the corresponding decoding processes for the transition frame where the TCX mode is switched to the AAC-ELD mode. According to the encoder described in Embodiment 11, the previous frame is coded in the TCX mode. After the TCX synthesis, the TCX synthesized signals are [$b_{i-2}$+aliasing, $a_{i-1}$, $b_{i-1}$+aliasing], and have a length of $$3/2N, \quad \text{[Math. 32]}$$

$a_{i-1}$ is shown as a sub-frame 1601 in FIG. 16.

For the current frame i, after the inverse low delay filter banks, the inverse transform signal is denoted as $y_i$ and has a length of 4N as shown below.

$$y_i = [-a_{i-3}w_1-(b_{i-3}w_2)_R+a_{i-1}w_5+(b_{i-1}w_6)_R,\ -(a_{i-3}w_1)_R-b_{i-3}w_2+(a_{i-1}w_5)_R+b_{i-1}w_6,\ -a_{i-2}w_3+(b_{i-2}w_4)_R+a_iw_7-(b_iw_8)_R,\ (a_{i-2}w_3)_R-b_{i-2}w_4-(a_iw_7)_R+b_iw_8,\ a_{i-3}w_1+(b_{i-3}w_2)_R-a_{i-1}w_5-(b_{i-1}w_6)_R,\ (a_{i-3}w_1)_R-b_{i-3}w_2-(a_{i-1}w_5)_R+b_{i-1}w_6,\ a_{i-2}w_3-(b_{i-2}w_4)_R-a_iw_7+(b_iw_8)_R,\ -(a_{i-2}w_3)_R+b_{i-2}w_4+(a_iw_7)_R-b_iw_8] \quad \text{[Math. 33]}$$

The aliasing portion $-(a_{i-3}w_1)_R-b_{i-3}w_2+(a_{i-1}w_5)_R+b_{i-1}w_6$, shown as a sub-frame 1602, is cancelled by the TCX synthesized signal $a_{i-1}$ and the reconstructed signal $out_{i-2}=[a_{i-3}, b_{i-3}]$ of the frame i-2 shown as sub-frames 1603 and 1604 to reconstruct the signal of the transition frame [$a_{i-1}$, $b_{i-1}$].

Figure 17:
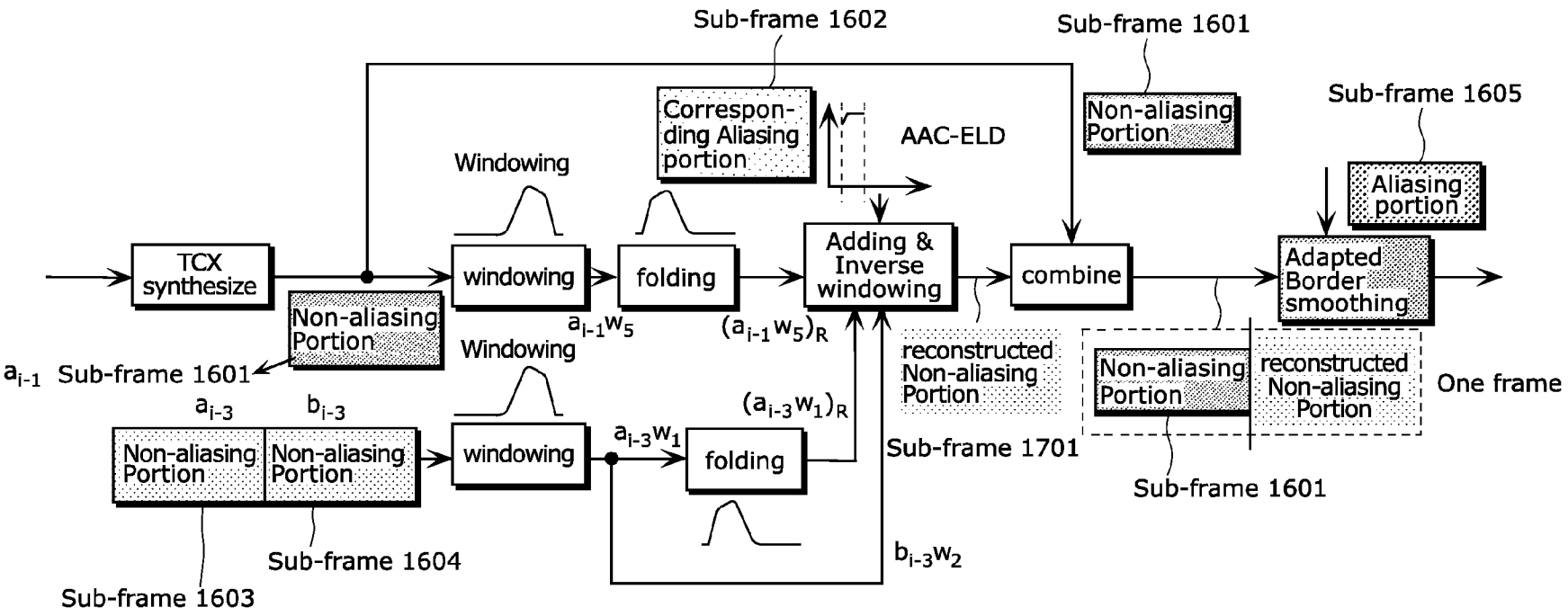
FIG. 17 is a diagram illustrating details of a decoding process for switching from the TCX mode to the AAC-ELD mode.

FIG. 17 illustrates one example of aliasing cancellation. The reconstructed signal $a_{i-3}$ of the frame i-2 is windowed to obtain $a_{i-3}w_1$ as shown in FIG. 17. The reverse vector of $a_{i-3}w_1$ is denoted as $(a_{i-3}w_1)_R$.

The second half of the $out_{i-2}$ is windowed to obtain $b_{i-3}w_2$.

The TCX synthesized signal $a_{i-1}$ is windowed to obtain $a_{i-1}w_5$. The reverse order of $a_{i-1}w_5$ is $(a_{i-1}w_5)_R$.

By adding and inverse windowing the re-produced aliasing components $b_{i-1}w_6$, a sub-frame 1701 ($b_{i-1}$) is reconstructed. To obtain the current transition frame, the sub-frame 1701 is concatenated with the sub-frame 1601 as shown in FIG. 17.

Figure 24:
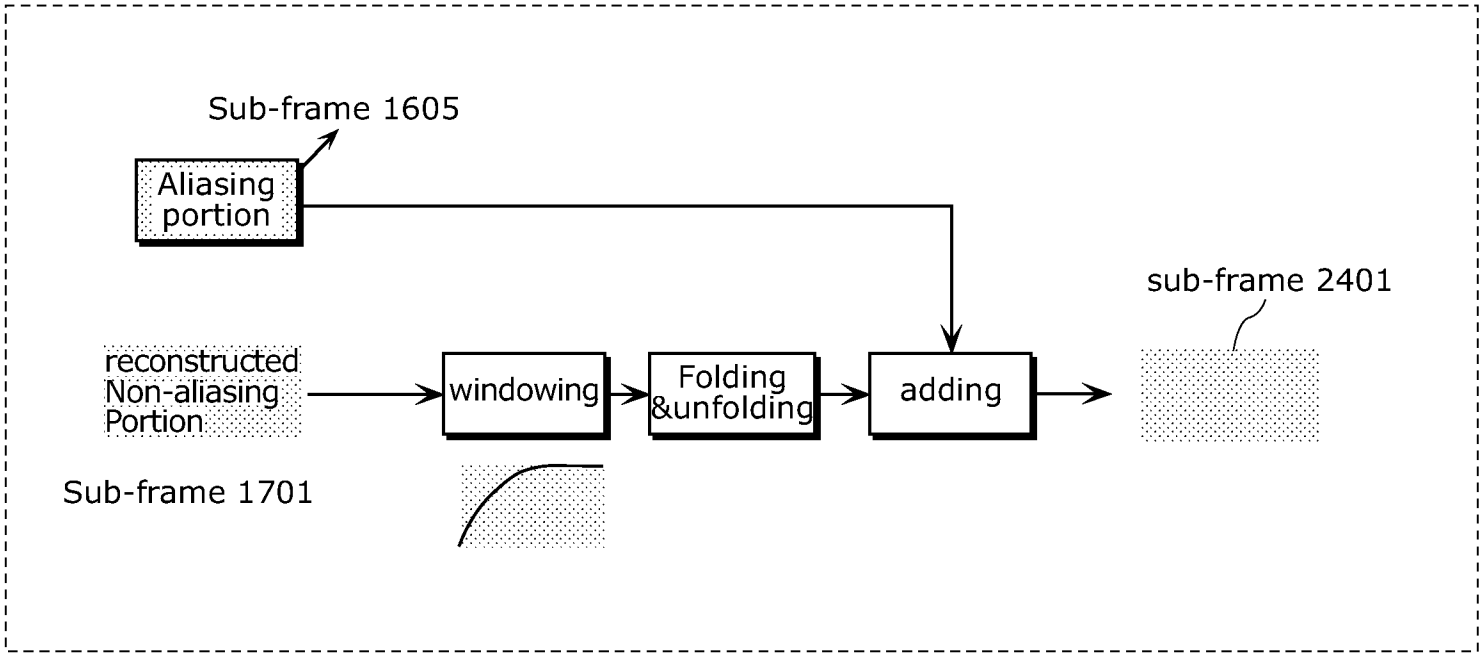
FIG. 24 is a diagram illustrating a smoothing process at a sub-frame border.

Due to the quantization error, the concatenation border is not smooth. An adapted border smoothing algorithm is invented to eliminate the artefacts. FIG. 24 is illustrates the sub-frame border smoothing processes.

The sub-frame 1701 ($b_{i-1}$) is windowed by the TCX window shape. Folding and unfolding processes are applied to generate the MDCT-TCX aliasing components. The outcome is overlapped with the aliasing portions of the sub-frame 1605, which are originally from the MDCT-TCX inverse transform, to obtain a sub-frame 2401. The border between the sub-frames 1601 and 2401 is smoothed by the overlapping and adding processes. The transient signal [$a_{i-1}$, $b_{i-1}$] is reconstructed.

Advantageous Effects

The decoder according to the present embodiment having the block switching algorithm cancels the aliasing of the frame i introduced by the AAC-ELD mode. This enables a seamless transition from the TCX mode to the AAC-ELD mode.

Embodiment 13

In Embodiment 13, a coding method for coding the transient signal in the low delay hybrid speech and audio codec is invented.

In the AAC-ELD codec, only the long window shape is used. It reduces the coding performance of the transient signal in which the energy has an abrupt change. To handle the transient signal, the short window is preferable. A transient signal coding algorithm is invented in the present embodiment. The current frame i having a transient signal is concatenated with the previous frame to form an extended frame having a longer frame size. Multiple short windows and an MDCT filter bank are used to code this processed frame.

Figure 18:
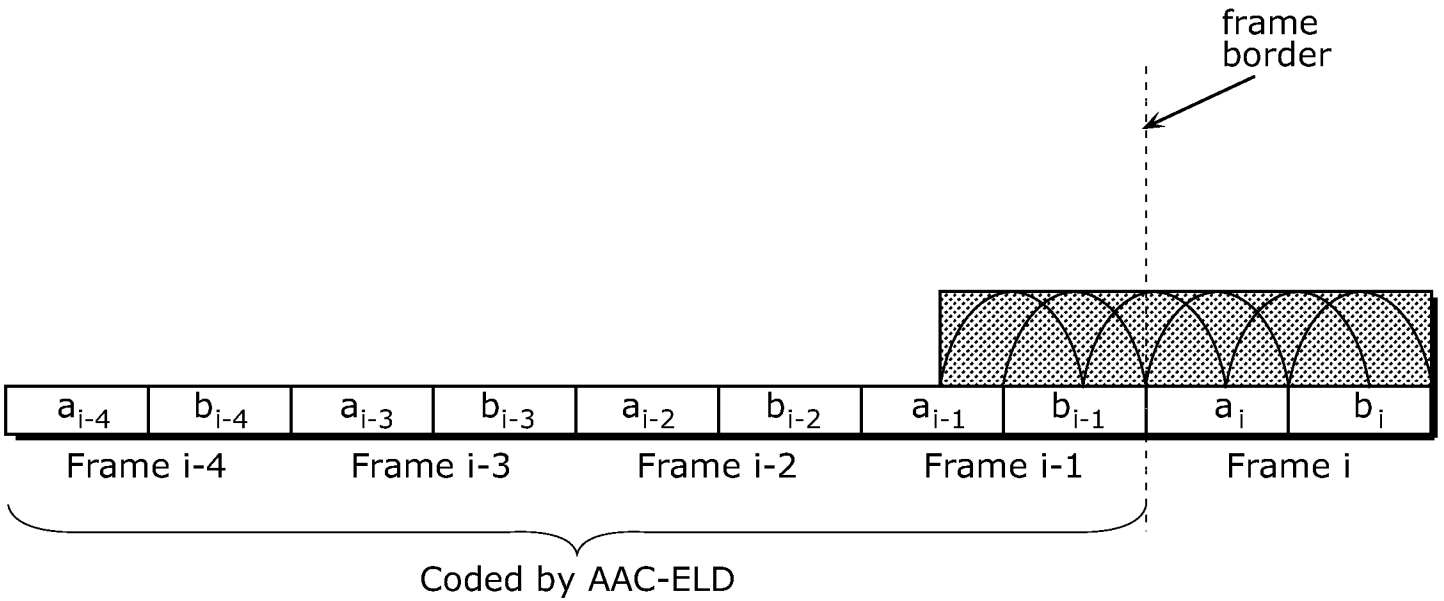
FIG. 18 is a diagram illustrating a process on a transient signal in an encoder.

The encoder framework is the same as Embodiments 1 and 2. FIG. 18 illustrates the coding processed in the encoder. The previous frame i-1 is coded together with three previous frames in the AAC-ELD mode. The frame i is concatenated with the previous frame as shown in FIG. 18. The length of the long extended transient frame is $$\left(N+\frac{1}{2}N+\frac{1}{4}N\right). \quad \text{[Math. 34]}$$

Six short windows having a length of $$1/2N \quad \text{[Math. 35]}$$

are applied on the extended frame. The shape of the short window can be any symmetric window used by the MDCT filter banks. The MDCT filer banks are applied to short windowed signals.

Advantageous Effect

The encoder according to the present embodiment provides the transient signal handling algorithm to improve the sound quality of the low delay hybrid codec which uses the AAC-ELD coding technology.

Embodiment 14

In Embodiment 14, a hybrid speech and audio decoder for decoding the transient signal is invented.

The transient frame i is coded by the short window MDCT as explained in Embodiment 13. In order to cancel the aliasing of the frame i-1, which is introduced by the AAC-ELD mode, the transient decoding method in the present embodiment uses the inverse MDCT transform signal of the frame i and the reconstructed signal of the frame i-3 to generate the inverse aliasing of the AAC-ELD mode.

Figure 19:
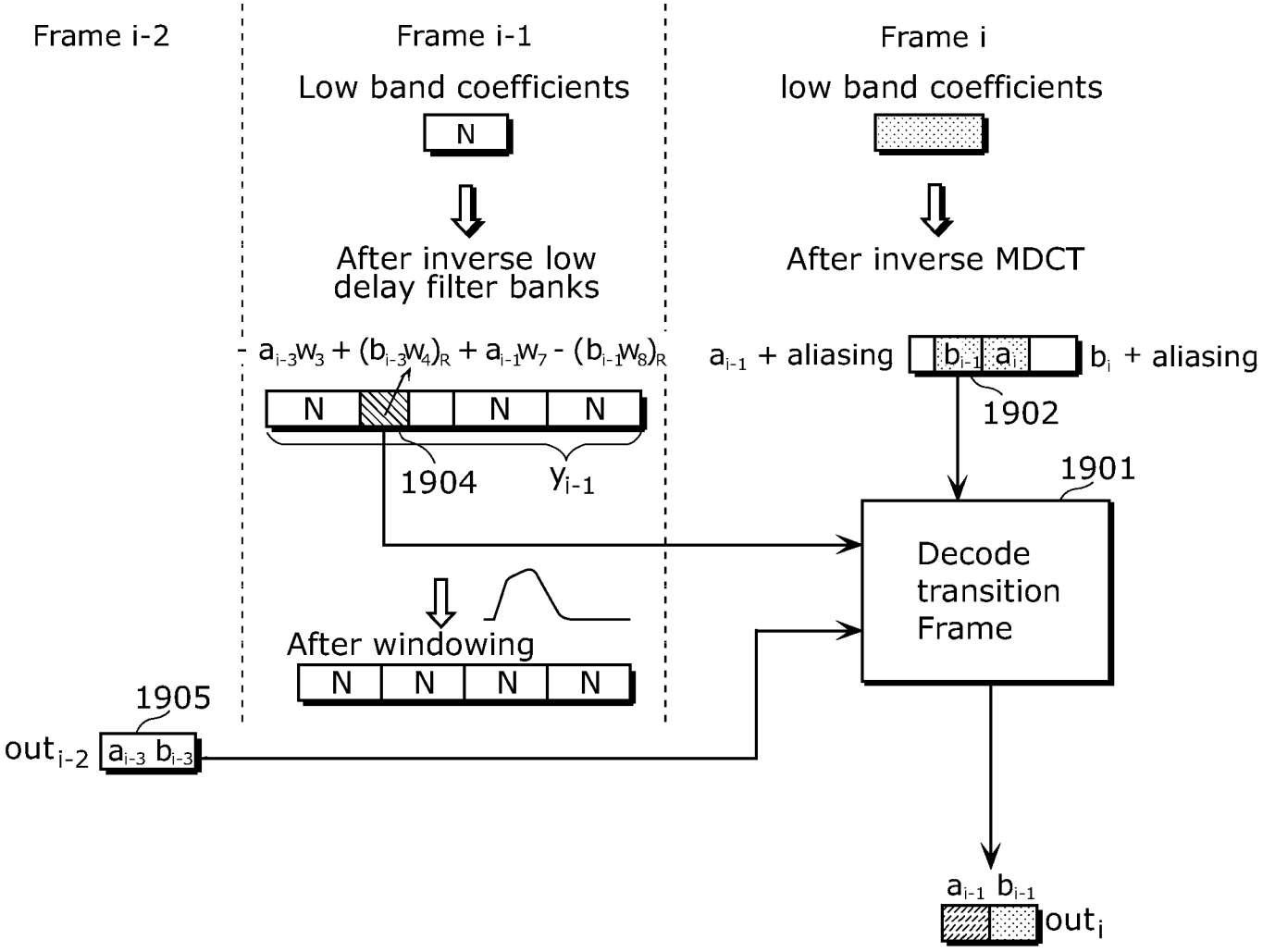
FIG. 19 is a diagram illustrating a decoding process on a transient signal.

The decoding processes of the transient frame are illustrated in FIG. 19. According to the coding processes described in Embodiment 13, after the IMDCT and overlapping and adding are performed, a signal 1902 is [$a_{i-1}$+aliasing, $b_{i-1}$, $a_i$, $b_i$+aliasing] with a length of $$\left(N+\frac{1}{2}N+\frac{1}{4}N\right). \quad \text{[Math. 36]}$$

The non-aliasing portion $b_{i-1}$ from MDCT, shown as 1902 in FIG. 19, the AAC-ELD inverse transform signal $y_{i-1}$ 1904 of the frame i-1 and the reconstructed signal $out_{i-2}=[a_{i-3}, b_{i-3}]$ 1905 of the frame i-3 are sent to a block 1901 in FIG. 19 for reconstructing the signal $[a_{i-1}, b_{i-1}]$. Therefore, the output of the frame i is $[a_{i-1}, b_{i-1}]$.

The processes of the block 1901 in FIG. 19 are the same as FIG. 8. The sub-frame 2301 in FIG. 23 is replaced by the non-aliasing portion 1902. The sub-frame 2302 that is the aliasing portion is replaced by 1904 in FIG. 19. The non-aliasing portion denoted as the sub-frames 2304 and 2305 are replaced by $out_{i-2}=[a_{i-3}, b_{i-3}]$ denoted as 1905 in FIG. 19.

Advantageous Effects

The invented decoder provides a transient signal handling method to improve the coding performance of the transient signal. As a result, the sound quality of the low delay hybrid codec which employs the AAC-ELD coding technology is improved.

INDUSTRIAL APPLICABILITY

The present invention relates, in general, to hybrid audio coding systems, and is more particularly related to hybrid coding systems which support audio coding and speech coding in low bitrate. The hybrid coding system combines the transform coding and the time domain coding. It can be used in broadcasting systems, mobile TVs, mobile phones communication, and teleconferences.

What is claimed is:

1. A hybrid audio decoder configured to decode a coded stream while switching between a speech coding mode in which linear prediction coefficients are used and an audio coding mode in which a low delay orthogonal transform is used, the hybrid audio decoder comprising:

a processor; and storage coupled to the processor, wherein the processor is configured to perform:

low delay decoding for decoding a coded signal in the audio coding mode using an inverse modified discrete cosine transform filter bank;

generating of a synthesized signal based on the low delay decoding;

audio decoding for decoding, in the speech coding mode, a coded signal including the linear prediction coefficients;

generating of an audio synthesized signal based on the audio decoding;

decoding of a signal of a portion of a current frame to be decoded, using a signal of a previous frame preceding the current frame; and combining of the decoded signal of the portion of the current frame and the audio synthesized signal of another portion of the current frame, to reconstruct a signal of the current frame, when the current frame is a frame to be decoded immediately before the audio coding mode is switched to the speech coding mode, wherein, in the low delay decoding, an extended frame is windowed in a plurality of short windows each having a shorter length than a frame, and the inverse modified discrete cosine transform filter bank is applied to the extended frame, the extended frame being generated by combining the current frame and the previous frame.

2. The hybrid audio decoder according to claim 1, wherein the signal of the portion of the current frame is decoded using: the audio synthesized signal of the other portion of the current frame; a plurality of inverse transform signals of the current frame from the inverse modified discrete cosine transform filter bank; and a reconstructed signal of the previous frame.

3. The hybrid audio decoder according to claim 2, wherein the hybrid audio decoder is configured to decode the linear prediction coefficients and algebraic code-excited coefficients to generate an algebraic code-excited linear prediction synthesized signal as the audio synthesized signal, and the signal of the portion of the current frame is decoded using: the algebraic code-excited linear prediction synthesized signal of the other portion of the current frame; the plurality of inverse transform signals of the current frame from the inverse modified discrete cosine transform filter bank; and the reconstructed signal of the previous frame, when the current frame is a frame to be decoded immediately before the audio coding mode is switched to the speech coding mode in which the algebraic code-excited coefficients and the linear prediction coefficients are used.

4. The hybrid audio decoder according to claim 2, wherein the hybrid audio decoder is configured to decode the linear prediction coefficients to generate a transform coded excitation synthesized signal as the audio synthesized signal by an orthogonal transform, and the signal of the portion of the current frame is decoded using: the transform coded excitation synthesized signal of the other portion of the current frame; the plurality of inverse transform signals of the current frame from the inverse modified discrete cosine transform filter bank; and the reconstructed signal of the previous frame, when the current frame is a frame to be decoded immediately before the audio coding mode is switched to the speech coding mode in which the transform coded excitation synthesized signal is generated by the orthogonal transform.

5. The hybrid audio decoder according to claim 1, wherein the hybrid audio decoder is configured to decode the linear prediction coefficients and algebraic code-excited coefficients to generate an algebraic code-excited linear prediction synthesized signal as the audio synthesized signal, and the signal of the current frame is reconstructed using at least two of: a plurality of inverse transform signals of the current frame from the inverse modified discrete cosine transform filter bank; an algebraic code-excited linear prediction synthesized signal of a first previous frame; and a reconstructed signal of a second previous frame, when the current frame is a frame to be decoded immediately after the speech coding mode in which the algebraic code-excited linear prediction coefficients are used is switched to the audio coding mode.

6. The hybrid audio decoder according to claim 1, wherein the hybrid audio decoder is configured to decode the linear prediction coefficients to generate a transform coded excitation synthesized signal as the audio synthesized signal by an orthogonal transform, and the signal of the current frame is reconstructed using: a plurality of inverse transform signals of a frame following the current frame from the inverse modified discrete cosine transform filter bank; the transform coded excitation synthesized signal of the portion of the current frame; and a reconstructed signal of the previous frame, when the current frame is a frame to be decoded immediately before the speech coding mode in which the transform coded excitation synthesized signal is generated by the orthogonal transform is switched to the audio coding mode.

7. A hybrid audio encoder configured to code an input signal while switching between a speech coding mode in which linear prediction coefficients are used and an audio coding mode in which a low delay orthogonal transform is used, the hybrid audio encoder comprising:

a processor; and storage coupled to the processor, wherein the processor is configured to perform:

signal classifying for classifying the input signal according to a characteristic of the input signal, and according to a result of the classifying, switching between the speech coding mode and the audio coding mode as a coding mode for coding the input signal;

low delay encoding for coding the input signal in the audio coding mode using a modified discrete cosine transform filter bank to generate a coded signal;

audio encoding for calculating linear prediction coefficients of the input signal in the speech coding mode to generate a coded signal including the linear prediction coefficients;

forming an extended frame by concatenating a current frame and a previous frame preceding the current frame, and coding an input signal of the extended frame, when the current frame is a frame to be coded immediately after the audio coding mode is switched to the speech coding mode; and transmitting the coded signal including the linear prediction coefficients to a receiver.

8. The hybrid audio encoder according to claim 7, wherein the hybrid audio encoder includes:

a transform coded excitation encoder configured to calculate an excitation residual using the calculated linear prediction coefficients, and calculate transform coded excitation coefficients using the excitation residual and the modified discrete cosine transform filter bank, to generate a coded signal including the transform coded excitation coefficients and the linear prediction coefficients; and an algebraic code-excited linear prediction encoder configured to generate a coded signal including the linear prediction coefficients and algebraic code-excited coefficients.

9. The hybrid audio decoder according to claim 3, wherein when the current frame is a frame to be decoded immediately before the audio coding mode is switched to the speech coding mode in which the algebraic code-excited coefficients and the linear prediction coefficients are used, the processor is configured to perform:

a. processing of the algebraic code-excited linear prediction synthesized signal of the other portion of the current frame by windowing and order arranging, to obtain a first signal;

b. processing of the reconstructed signal of the previous frame by windowing and order arranging, to obtain a second signal;

c. adding of the first signal and the second signal to the plurality of inverse transform signals of the current frame from the inverse modified discrete cosine transform filter bank, to obtain a third signal;

d. processing of the third signal by windowing and order arranging, to obtain a fourth signal as the signal of the portion of the current frame; and e. concatenating of the fourth signal with the algebraic code-excited linear prediction synthesized signal of the other portion of the current frame to obtain a reconstructed signal as the signal of the current frame.

10. The hybrid audio decoder according to claim 5, wherein when the current frame is a frame to be decoded immediately after the speech coding mode in which the algebraic code-excited linear prediction coefficients are used is switched to the audio coding mode, the processor is configured to perform:

a. processing of the reconstructed signal of the second previous frame which is three frames before the current frame by windowing and order arranging, to obtain a first signal;

b. processing of the algebraic code-excited linear prediction synthesized signal of the first previous frame which is one frame before the current frame by windowing and order arranging, to obtain a second signal;

c. adding of the first signal and the second signal to obtain a third signal; and d. processing of the third signal by windowing and order arranging, to obtain a portion of an inverse low delay orthogonal transform signal of the current frame.

11. The hybrid audio decoder according to claim 5, wherein when the current frame is a frame to be decoded immediately after the speech coding mode in which the algebraic code-excited linear prediction coefficients are used is switched to the audio coding mode, the processor is configured to perform:

a. processing of the reconstructed signal of the second previous frame which is two frames before the current frame by windowing and order arranging, to obtain a first signal;

b. adding of the first signal and the reconstructed signal of the second previous frame to the plurality of inverse transform signals of the current frame from the inverse modified discrete cosine transform filter bank, to obtain a third signal; and c. processing of the third signal by windowing and order arranging, to obtain a portion of an inverse low delay transform signal of the current frame.

12. The hybrid audio decoder according to claim 4, wherein when the current frame is a frame to be decoded immediately before the audio coding mode is switched to the speech coding mode in which the transform coded excitation synthesized signal is generated by the orthogonal transform, the processor is configured to perform:

a. processing of the transform coded excitation synthesized signal of the other portion of the current frame by windowing and order arranging, to obtain a first signal;

b. processing of the reconstructed signal of the previous frame by windowing and order arranging, to obtain a second signal;

c. adding of the first signal and the second signal to the plurality of inverse transform signals of the current frame from the inverse modified discrete cosine transform filter bank, to obtain a third signal;

d. processing of the third signal by windowing and order arranging, to obtain a fourth signal as the signal of the portion of the current frame; and e. concatenating of the fourth signal with the transform coded excitation synthesized signal of the current frame to obtain a reconstructed signal as the signal of the current frame.

13. The hybrid audio decoder according to claim 6, wherein when the current frame is a frame to be decoded immediately before the speech coding mode in which the transform coded excitation synthesized signal is generated by the orthogonal transform is switched to the audio coding mode, the processor is configured to perform:

a. processing of the transform coded excitation synthesized signal of the portion of the current frame by windowing and order arranging, to obtain a first signal;

b. processing of the reconstructed signal of the previous frame by windowing and order arranging, to obtain a second signal;

c. adding of the first signal and the second signal to the plurality of inverse transform signals of the frame following the current frame from the inverse modified discrete cosine transform filter bank, to obtain a third signal;

d. processing of the third signal by windowing and order arranging, to obtain a fourth signal as a signal of the other portion of the current frame; and e. concatenating of the fourth signal with the transform coded excitation synthesized signal of the portion of the current frame to obtain a reconstructed signal as the signal of the current frame.

14. The hybrid audio decoder according to claim 1, wherein the processor is configured to perform:

a. processing of a reconstructed signal of a plurality of current frames to be decoded from the inverse modified discrete cosine transform filter bank by windowing and order arranging, to obtain a first signal;

b. processing of the reconstructed signal of the previous frame by windowing and order arranging, to obtain a second signal;

c. adding of the first signal and the second signal to inverse transform signals of a plurality of previous frames from the inverse modified discrete cosine transform filter bank, to obtain a third signal;

d. processing of the third signal by windowing and order arranging, to obtain a fourth signal; and e. concatenating of the fourth signal with the reconstructed signal of the current frames from the inverse modified discrete cosine transform filter bank, to obtain a reconstructed signal.

* * * * *